US007546716B1

(12) United States Patent
Asadurian

(10) Patent No.: US 7,546,716 B1
(45) Date of Patent: Jun. 16, 2009

(54) APPARATUS AND METHOD FOR CONSTRUCTING WALLS WHICH INCLUDE BOTH EXTERIOR PARTITION WALLS AND ALSO INTERIOR PARTITION WALLS

(76) Inventor: Armond Asadurian, 10220 Genesta Ave., Northridge, CA (US) 91325

( * ) Notice: Subject to any disclaimer, the term of this patent is extended or adjusted under 35 U.S.C. 154(b) by 341 days.

(21) Appl. No.: 11/701,941

(22) Filed: Feb. 2, 2007

(51) Int. Cl.
*E04B 1/02* (2006.01)
*E04C 3/30* (2006.01)

(52) U.S. Cl. ..... 52/570; 52/606; 52/604; 52/590.2; 52/592.6; 52/223.7; 52/282.1; 52/263; 52/309.12; 52/476

(58) Field of Classification Search ..... 52/570–572, 52/603–608, 220, 220.2, 266, 282.2, 284, 52/306–308, 223.7, 503, 505, 590.1, 590.2, 52/590.3, 309.12, 588.1, 578, 592.5, 592.6, 52/566, 569, 561, 612, 474, 576, 568, 437, 52/36.4, 270, 271, 444, 744; 405/21, 262, 405/284; 446/108, 124, 127
See application file for complete search history.

(56) References Cited

U.S. PATENT DOCUMENTS

| | | | | |
|---|---|---|---|---|
| 1,562,728 | A | 11/1925 | Albrecht | |
| 1,898,297 | A * | 2/1933 | Barcley | 446/122 |
| 3,037,593 | A * | 6/1962 | Webster | 52/476 |
| 3,511,005 | A | 5/1970 | MacMaster | |
| 3,798,861 | A | 3/1974 | Weiss | |
| 4,115,980 | A | 9/1978 | Martel et al. | |
| 5,181,362 | A | 1/1993 | Benitez | |
| 5,267,863 | A | 12/1993 | Simmons, Jr. | |
| 5,588,271 | A | 12/1996 | Pitchford | |
| 5,775,046 | A | 7/1998 | Fanger et al. | |
| D403,437 | S | 12/1998 | Risi et al. | |
| 5,901,520 | A | 5/1999 | Abdul-Baki | |
| 6,122,881 | A * | 9/2000 | Aubertot | 52/604 |
| 6,244,009 | B1 | 6/2001 | Cerrato | |
| 6,550,208 | B2 * | 4/2003 | Nanayakkara | 52/606 |
| 6,817,154 | B2 | 11/2004 | Dolan et al. | |
| 2003/0234488 | A1 | 12/2003 | Povitz | |
| 2004/0177575 | A1 | 9/2004 | Posselt | |
| 2006/0010810 | A1 | 1/2006 | Muszynski | |

* cited by examiner

*Primary Examiner*—Lynda Jasmin
*Assistant Examiner*—Ahmed Khalil
(74) *Attorney, Agent, or Firm*—Thomas I. Rozsa

(57) ABSTRACT

The present invention is related to an apparatus and method of constructing walls of framed block assemblies including both exterior and interior partition walls which are assembled through an interlocking structure having dovetail tongues interlocked with dovetail channels. Includes are a plain wall, a wall with mortar for ornamentation, and a wall applied with straight longitudinal blocks.

20 Claims, 20 Drawing Sheets

APPARATUS AND METHOD FOR CONSTRUCTING WALLS WHICH INCLUDE BOTH EXTERIOR PARTITION WALLS AND ALSO INTERIOR PARTITION WALLS

BACKGROUND OF THE INVENTION

1. Field of the Invention

The present invention is related to an apparatus and method for constructing walls, and more particularly to a method to construct walls of framed block assemblies which contain the fundamental blocks are frame members having an interlocking structure.

2. Description of the Prior Art

The following 15 patents and published patent applications are the closest prior art references which are related to the present invention.

1. U.S. Pat. No. 1,562,728 issued to Theodore Julius John Albrecht on Nov. 24, 1925 for "Building Construction" (hereafter the "Albrecht Patent");

2. U.S. Pat. No. 3,511,005 issued to Gordon MacMaster on May 12, 1970 for "Building Construction" (hereafter the "MacMaster Patent");

3. U.S. Pat. No. 3,798,861 issued to Alexander C. H. Weiss on Mar. 26, 1974 for "Wall Construction Module And System" (hereafter the "Weiss Patent");

4. U.S. Pat. No. 4,115,980 issued to Charles Simeon Martel et al. on Sep. 26, 1978 for "Wall System" (hereafter the "Martel Patent");

5. U.S. Pat. No. 5,181,362 issued to Rafael C. Benitez on Jan. 26, 1993 for "Interlocking Building Blocks" (hereafter the "Benitez Patent");

6. U.S. Pat. No. 5,267,863 issued to Felix J. Simmons, Jr. on Dec. 7, 1993 for "interlocking Pixel Blocks And Beams" (hereafter the "Simmons Patent");

7. U.S. Pat. No. 5,588,271 issued to Peter R. Pitchford on Dec. 31, 1996 for "Interlocking Building Block" (hereafter the "Pitchford Patent");

8. U.S. Pat. No. 5,775,046 issued to David J. Fanger et al. and assigned to Massachusetts Institute of Technology on Jul. 7, 1998 for "Modular Construction Member" (hereafter the "Fanger Patent");

9. U.S. Design Patent No. Des. 403,437 issued to Angelo Risi et al. and assigned to Rothbury International Inc. on Dec. 29, 1998 for "Modular Block" (hereafter the "Risi Design Patent");

10. U.S. Pat. No. 5,901,520 issued to Assad Abdul-Baki on May 11, 1999 for "Interlocking Building Blocks" (hereafter the "Abdul-Baki Patent");

11. U.S. Pat. No. 6,244,009 issued to Dominic Cerrato on Jun. 12, 2001 for "Flexible Interlocking Wall System" (hereafter the "Cerrato Patent");

12. U.S. Published Patent Application No. 2003/0234488 issued to Cary Povitz on Dec. 25, 2003 for "Multiple Game Block Assembly" (hereafter the "Povitz Published Patent Application");

13. U.S. Published Patent Application No. 2004/0177575 issued to Klaus Posselt on Sep. 16, 2004 for "System Of Interlocking Wall And Corner Components For Construction Of Buildings" (hereafter the "Posselt Published Patent Application");

14. U.S. Pat. No. 6,817,154 issued to John Fitzgerald Dolan et al. and assigned to New Technology Resources, Inc. on Nov. 16, 2004 for "Environment Resistant Retaining Wall Block And Methods Of Use Thereof" (hereafter the "Dolan Patent");

15. U.S. Published Patent Application No. 2006/0010810 issued to Arkadiusz Muszynski on Jan. 19, 2006 for "Wall Construction Using Hollow Glass Building Elements" (hereafter the "Muszynski Published Patent Application");

The Albrecht Patent discloses creating a vertical dovetail recess to the upper portion of the block and a mating dove tail tongue 3 projecting from underneath the surface which interlocks with the dovetail recess of the block immediately below. It discloses the concept of having interlocking male tongues and female channels to receive them in the horizontal orientation. In addition, it discloses the concept of having vertical dove tail tongues 12 which are fitted at a right angle portion into an engaging slot as best shown in the top view of FIG. 2.

The MacMaster Patent discloses a wall construction consisting of a frame within which are arranged blocks that are secured to the frame to form complete wall panels or enclosures. Essentially they consist of male members such as 81*a* which insert into the upper portion of a horizontal block and also in the side wall of a horizontal block which inserts into a corresponding female member in the lower portion of the block and in the side wall of the block and are held together with pins 90. This patent discloses the concept of having male vertical members extending from the horizontal section into being inserted into mating female channels to create a wall structure as shown in FIG. 1. It can also be half blocks to give it a more fanciful design. The blocks are described as being made of wood.

The Weiss Patent discloses a wall system which also discloses the concept of having the interlocking blocks pre-made in the factory so they can be interlocked to create a wall. As discussed in Column 4, Lines 10 through 22 the patent states "In addition to the interlocking engagement of the members 26 with the vertical tapered ends of the stacked modules as shown in FIG. 7, there is a secure stabilizing interlocking and interfitting relationship between the tops and bottoms of adjacent modules 10 in each vertical course of the wall or partition as depicted in FIG. 8. That is to say, the upper tapered end of each module 10 having the converging faces 17 interfits with the correspondingly recessed bottom of the next module having the converging faces 20. In this manner, the vertical courses or flights in the wall can be erected easily in a factory or on a job site by unskilled labor and with a minimum effort, as will be further explained."

The Martel Patent discloses a wall system wherein each block has female dove tail members as best illustrated in FIG. 1 wherein adjacent blocks have a male pin type structure 111 as illustrated in FIG. 3 which is hammered into adjacent blocks to form a wall.

The Benitez Patent is an interlocking building block system which contains a male protrusion 20 on one surface and a female slot 56 on another surface so that the blocks can be vertically affixed together with a male on one side inserted into a female on the other side. The next row of blocks can be offset as also shown in FIG. 2. On the horizontal surface there are also male protrusions which insert into female corresponding protrusions on a lower surface of each corresponding block. This forms a strong structure. However, this is not a prefabricated structure but is essentially a concept where interlocking building blocks are joined as they are being cemented together by a mason.

The Simmons Patent primarily deals with a graphic artwork pixel interlocking blocks but it discloses the concept of having blocks containing interlocking male protruding members and female receiving slots so they can be interlocked. In addition, a graphic artifact forms from pixels which may be implemented as interlocked pixel blocks of the invention.

The Pitchford Patent discloses a multiplicity of interlocking building blocks which can be placed within a frame assembly. It further discloses the concept of having building blocks which have a male receiving member which are inserted into female slots and the frame. In addition, the upper surfaces of each of the male blocks contain male grooves which can be inserted into female receiving members at the lower surface of each block. The Patent through FIGS. 3 and 4 illustrates one method of constructing a block wall using blocks 10 wherein a first row of blocks 56 are assembled and then additional rows, such as row 58 are assembled and mounted on top of row 56. Optional frame 60 may be used to box in the wall of blocks or other capping strips may be used. A frame member such as frame 6 shown in FIGS. 3 and 4 would be two parallel groves 62 to accommodate the rims 40 and 44 on either side of the blocks. FIG. 15 illustrates another use for capping strips 70 in that it can be mounted to another surface such as by screws 90 and thus used to anchor a wall formed by blocks 10 to a floor or other wall or other supporting surfaces.

The Fanger Patent discloses a modular constructor member which basically has a multiplicity of generally isosceles shaped triangle male protrusions and female receiving members so that they can be fitted together to form a block wall, wherein there are both horizontal and vertical interfitting members to create the structure.

The Risi Patent is a design patent which discloses the shape of the object as opposed to its functional features. However, what is disclosed is having a male protrusion from the top and a bottom receiving protrusion on the bottom wall so that one male protrusion can be inserted into a female protrusion on the next row of blocks.

The Abdul-Baki Patent once again discloses a concept of having interlocking building blocks which are light in weight and may be assembled without the use of mortar or other building agents. A series of interlocking blocks may be assembled to form gravity retaining walls or other rigid structures. The invention is described as providing non flammable lightweight interlocking, self-aligning blocks for use in constructing walls.

For the Cerrato Patent it discloses a masonry wall system incorporating a plurality of masonry and blocks each consisting of interlocking dove tails 12 along with a vertical and horizontal mating surfaces 11, 15, 16 and 17. "Each main block includes an upper interlocking device for interlocking with vertically adjacent blocks, and a lower interlocking device for interlocking with vertically adjacent blocks. A plurality of reinforcing structures are placed in the stabilization holes through a plurality of the main blocks. Each of the reinforcing structures is sized to permit movement of the main blocks along horizontal planes for a predetermined extent in a direction perpendicular to at least one of the wall faces. As a result, the horizontal movement to the predetermined extent transfers stress to adjacent blocks."

The Povitz Published Patent Application discloses a multiple game block puzzle. "A multiple game block puzzle comprises a plurality of interlocked block members. Each block member has first, second, third and fourth block member edges, which define a first surface and a first pictorial image, which includes a first plurality of partial pictorial images. Each partial pictorial image corresponds to a portion of the first pictorial image. The first partial pictorial images are attached to the first surface of each one of the block members and are aligned along at least two block member edges to match the first pictorial image to a first reference copy thereof. A kit including the puzzle is also provided."

The Pbsselt Published Patent Application specifically discloses "A system of interlocking wall and corner components for construction of a building include a plurality of elongate key members and a plurality of elongate side members. The key members are arranged as horizontal pairs of parallel upper and lower key members sandwiching therebetween pairs of parallel side members. The pair of parallel upper and lower key members form therebetween a pair of dove-tail joint female receiver sockets. Opposed facing sides of the pairs of parallel side members have a corresponding pair of laterally inwardly disposed dove-tail joint male members for mating into dove-tail engagement in the female receiver sockets to form a dove-tail joint. The pairs of key members and the pairs of side members form elongate horizontal beams mountable one on top of another to form a vertical array of wall layers." The patent application has the concept of interlocking horizontal sections with a male tongue and female groove remaining vertical wall portions and also on the side walls there is shown the center post 18. Specifically, "In FIGS. 4, 4*a* and 4*b*, a corner post 40 is mounted to side members 12 by means of dovetail joints. Post 40 has projecting tails 42 formed on adjacent sides. Side members 12 are vertically chamfered so that the chamfers when in opposed facing relation cooperatively form a socket 44. Tails 42 fit snugly into sockets 44. Key members 14 are trimmed so as to abut projecting tails 42 when the key members are mounted onto the side members. The mating inside corners of the inside side members are further chamfered as at 46 allowing a close tolerance inside cover fit."

The Dolan Patent shows a system of interlocking environment or retaining walls which basically have interlocking side members that mate with each other.

The Muszynski Published Patent Application discloses a wall construction using hollow glass building elements. The construction unit to be used in erecting both flat and arched profiled walls consist of supporting elements being the horizontal and vertical fasteners 1 and 2 in a form of joined blocks, where there are male and female members that form interlocking vertical rows and horizontal rows.

There is a significant need to provide a method for constructing walls of the framed block assemblies to contain the fundamental structure of the wall including blocks and frame members with interlocking means, so that, the walls can be efficiently and effectively assembled.

SUMMARY OF THE INVENTION

The present invention is related to a method for constructing a wall which is a framed block assembly to contain the fundamental structure of blocks and frame members, wherein the blocks and frame members include interlocking means. The method includes a first step to construct the entire block assembly through the interlocking of blocks in the respective upper and lower section which starts with interlocking a bottom section of the blocks to a bottom horizontal frame member. A framing step is then completed wherein a top horizontal frame member interlocks the top section of the blocks and a right and left side vertical frame member covers the respective right and left sides of the block assembly, which is followed by affixation of a right and left vertical frame member to the top and bottom horizontal frame member. The last step of the method is installation of the wall through interlocking the right and left vertical frame member to a respective right and left vertical post which is stabilized on or in the ground. The walls constructed with the present invention method can be varied to be a plain wall, a wall with simulated mortar and a wall with straight longitudinal blocks. In addition, various designs of the wall are disclosed for ornamentation.

It has been discovered, according to the present invention, that if a wall is a framed block assembly which is assembled with a plurality of pre-made blocks each of which is comprised of a top elongated dovetail tongue and a bottom elongated dovetail slot or channel, then the block assembly can be quickly and simply constructed from the present invention method through interlocking a block in the upper section of the block assembly to two blocks in the next lower section, wherein the upper block is interspaced between two lower blocks.

It has also been discovered, according to the present invention, that if a top and bottom horizontal frame member comprises the respective dovetail tongue lot and channel, the wall of the framed block assembly from the present invention method can be completed through a framing process after interlocking of the top horizontal frame member and a top section of the block assembly through a joinder of the dovetail tongue of the frame member and the dovetail channels of the blocks, and interlocking of the bottom horizontal frame member and a bottom section of the block assembly through a joinder of the dovetail tongue of the frame member and the dovetail slot of the blocks, in addition to affixation of the right and left vertical side frame member to the top and bottom horizontal frame member, wherein the right and left side vertical frame member further covers the respective right and left vertical side of the block assembly.

It has been further discovered, according to the present invention, that is a right and left side vertical frame member comprise a dovetail channel on the respective right and left outer side of the frame member, the wall of the framed block assembly can be easily installed onto the ground wherein the dovetail tongue of the right and left vertical frame member of the wall can be slid into a respective dovetail slot or channel of the respective right and left side vertical post which are stabilized on or into the ground.

It has been additionally discovered, according to the present invention, if a vertical insert with a narrow thickness is placed between two blocks in series which vertical insert has the similar structural features of the block except for a recess width, and an elongated horizontal insert is placed into a combined groove which is formed from a combination of grooves at the bottom of the vertical sides of the blocks in the upper section of the block assembly and grooves at top of the vertical sides of the blocks in the next lower section, then the present invention method for constructing walls can create a wall with simulated mortar for ornamentation.

It has been further additionally discovered, according to the present invention, that if a wall is a framed straight longitudinal block assembly, wherein the block assembly is assembled with a plurality of pre-made straight longitudinal blocks each of which is comprised of a top elongated dovetail tongue and a bottom elongated dovetail slot or channel, then the wall of the framed straight block assembly can be quickly and simply constructed from the present invention method through interlocking a block in the upper section of the wall to a block in the next lower section, in addition to a subsequent framing step of the method.

It has also been discovered, according to the present invention, that a plurality of blocks and frame members are pre-made wherein each of which is a hollow structure and comprises an interlocking means so that a wall of the framed block assembly can be easily assembled from the present invention method for constructing walls which can be used for both exterior and interior partition walls, wherein the method does not require special skills, toolings and fixtures, and the blocks and frame members are of a simple design and light in weight.

It is an object of the present invention to provide a wall which is a framed block assembly which is assembled with a plurality of pre-made blocks each of which is comprised of a top elongated dovetail tongue and a bottom elongated dovetail slot or channel, so that the block assembly can be quickly and simply constructed from the present invention method though interlocking a block in the upper section of the block assembly to two blocks in the next lower section, wherein the upper block is interspaced between the two lower blocks.

It is also an object of the present invention to provide a top and bottom horizontal frame member which comprises the respective dovetail tongue and slot, so that the wall of the framed block assembly from the present invention method can be completed through a framing step after interlocking of the top horizontal frame member and a top section of the block assembly through a joinder of the dovetail tongue of the frame member and the dovetail channel of the blocks, and interlocking of the bottom horizontal frame member and a bottom section of the block assembly through a joinder of the dovetail tongue of the frame member and the dovetail slots of the blocks, in addition to affixation of the right and left vertical side frame members to the top and bottom horizontal frame member, wherein the right and left side vertical frame members further cover the respective right and left vertical side of the block assembly.

It is an additional object of the present invention to provide a right and left side vertical frame member which comprise a dovetail channel on the respective right and left outer side of the frame member, so that the wall of the framed block assembly can be easily installed onto or into the ground wherein the dovetail tongue of the right and left vertical frame member of the wall can be slid into a respective dovetail slot or channel of the respective right and left side vertical post which are stabilized on or in the ground.

It is a further object of the present invention to provide a vertical insert with a narrow thickness which is placed between two blocks in series wherein the vertical insert has similar structural features to the block except for a recess width, and an elongated horizontal insert is placed into a combined groove which is formed from a combination of grooves at the bottom of the vertical sides of the blocks in the upper section of the block assembly and grooves at top of the vertical sides of the blocks in the next lower section, so that the present invention method for constructing walls can create a wall with simulated mortar for ornamentation.

It is still a further object of the present invention to provide a wall which is a framed straight longitudinal block assembly, wherein the block assembly is assembled with a plurality of pre-made straight longitudinal blocks each of which is comprised of a top elongated dovetail tongue and a bottom elongated dovetail slot, so that the wall of the framed straight block assembly can be speedily and simply constructed from the present invention method through interlocking a block in the upper section of the wall to a block in the next lower section, in addition to a following framing step of the method.

It is still an another object of the present invention to provide a plurality of blocks and frame members which are pre-made wherein each of which is a hollow structure and comprises the interlocking means, so that a wall of the framed block assembly can be easily assembled from the present invention method for constructing walls which can be used as both exterior and interior partition walls, wherein the method does not require special skills, tooling and fixtures, and the blocks and frame members are simple design and of light weight.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 6:
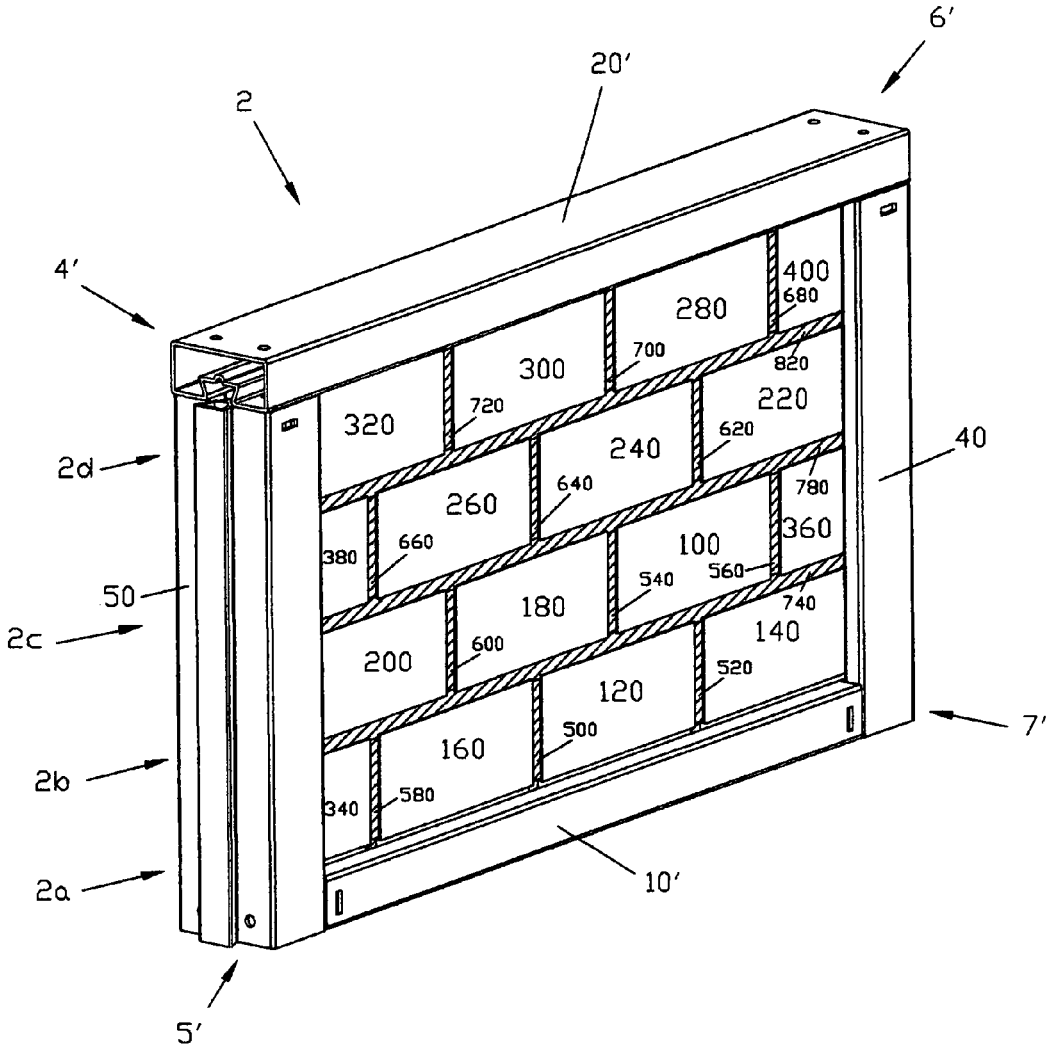
FIG. 6 is a perspective view to illustrate another preferred embodiment wall with mortar for the present invention method for constructing walls, wherein the embodiment additionally includes the vertical inserts to receive the simulated the vertical mortar and the horizontal inserts to receive the horizontal mortar in addition to all the structural members shown in the plain wall of FIG. 1.
Figure 9:
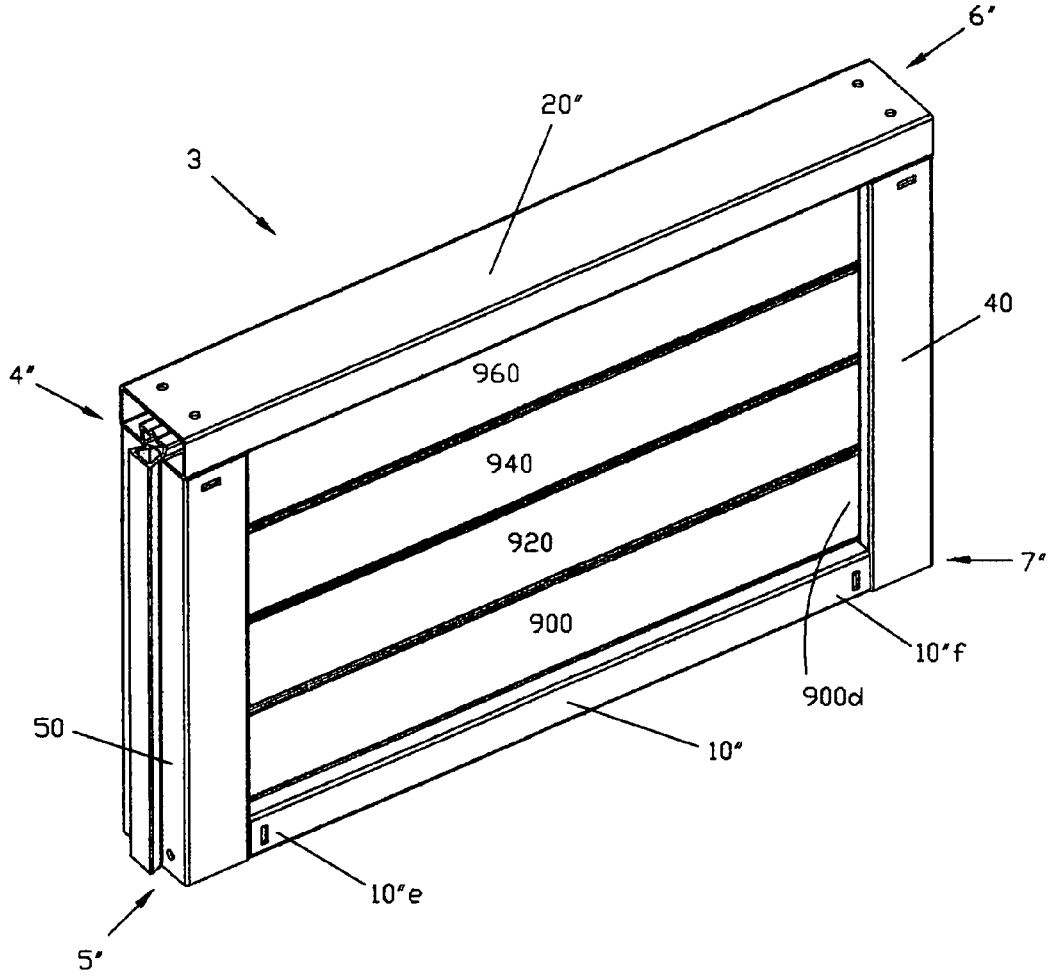
FIG. 9 is a perspective view to illustrate an additional preferred embodiment wall with straight longitudinal blocks from the present invention method for constructing walls, wherein the embodiment includes the straight longitudinal blocks, the right and left side vertical frame members, and the top and bottom elongated horizontal frame members.

The present invention is related to a method of constructing walls including both exterior and interior partition walls having the framed block assemblies which are assembled through an interlocking affixation from the fundamental blocks and frame members having interlocking means. Depicted throughout FIGS. 1, 6, and 9 are three preferred embodiments of the constructed walls from the present invention method as claimed, wherein FIG. 1 illustrates one preferred embodiment of a framed plain wall 1 with the vertical and horizontal frame members, FIG. 6 introduces an another preferred embodiment of a framed wall 2 with mortar for ornamentation, and FIG. 9 shows an additional preferred embodiment 3 of a framed wall created from straight longitudinal blocks.

Figure 1:
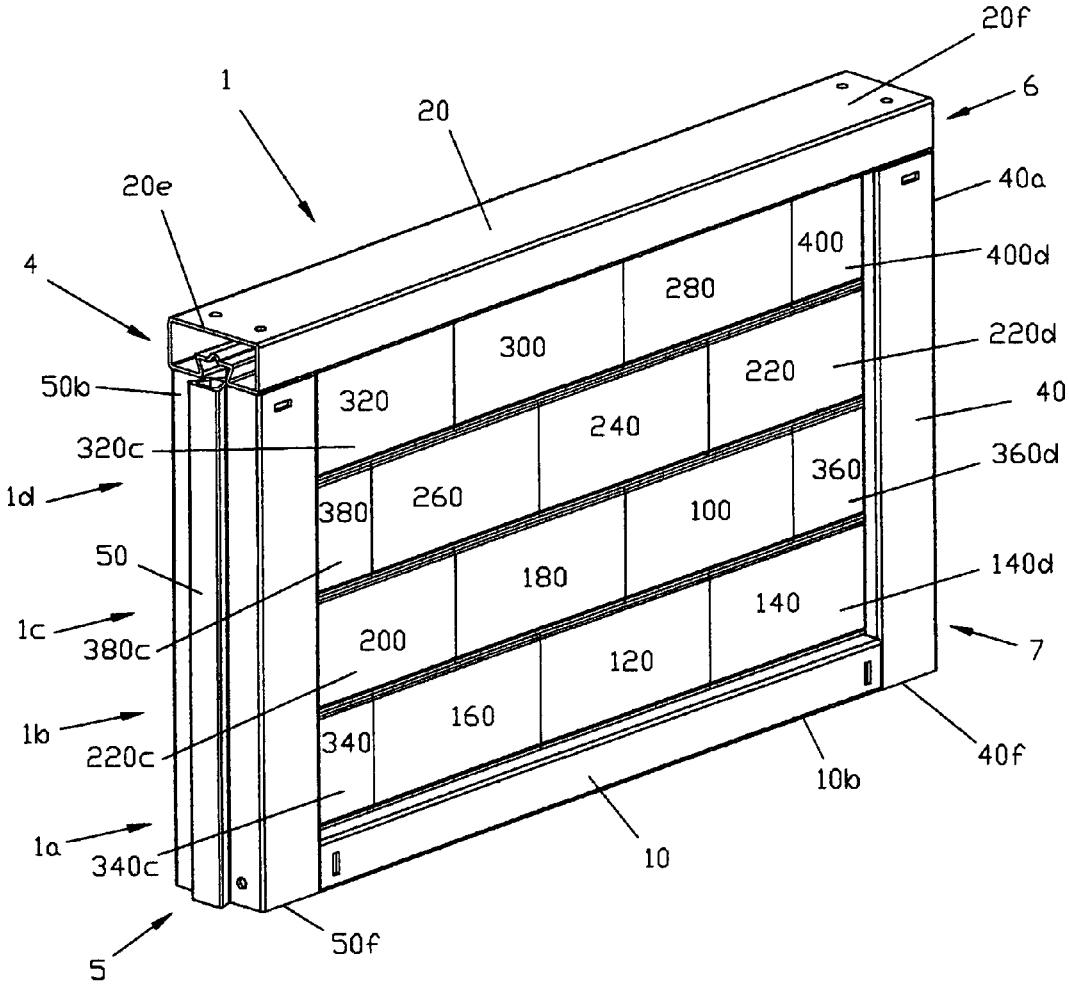
FIG. 1 is a perspective view to illustrate one preferred embodiment plain wall from the present invention method for constructing walls, wherein the plain wall includes the standard full and half sized blocks, the upper and bottom horizontal elongated frame member, and the right and left side vertical frame members.

Referring to FIG. 1, there is illustrated one preferred embodiment of the framed plain wall 1 of the present invention new method for constructing walls including both exterior and interior partition walls. The framed plain wall 1 is consisted of a top and bottom horizontal elongated frame member 20 and 10, a right and left side vertical elongated frame member 40 and 50, a plurality of the identical full sized blocks 100, 120, 140, 160, 180, 200, 220, 240, 260, 280, 300 and 320, and the multiplicity of half sized blocks 340, 360, 380, and 400.

Figure 2A:
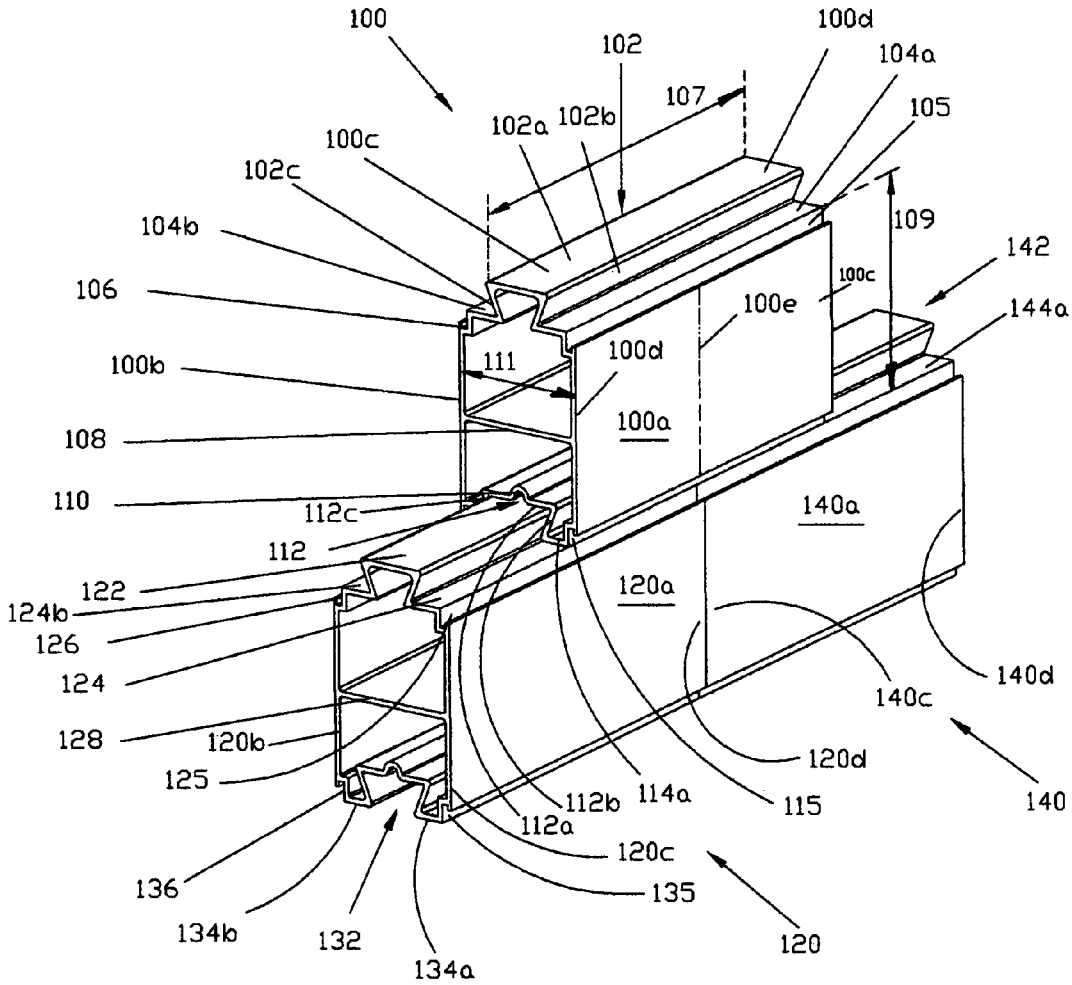
FIG. 2A is a perspective view of three identical full sized blocks which are used to illustrate the block interlocking affixation which is one of the fundamentals of the present invention method for constructing walls, wherein the first block is interspaced between two adjacent blocks on the next lower section, and further interlocked to the two blocks through a joinder of an elongated dovetail horizontal channel of the first block and an elongated dovetail horizontal tongue on each of the other two block.
Figure 2B:
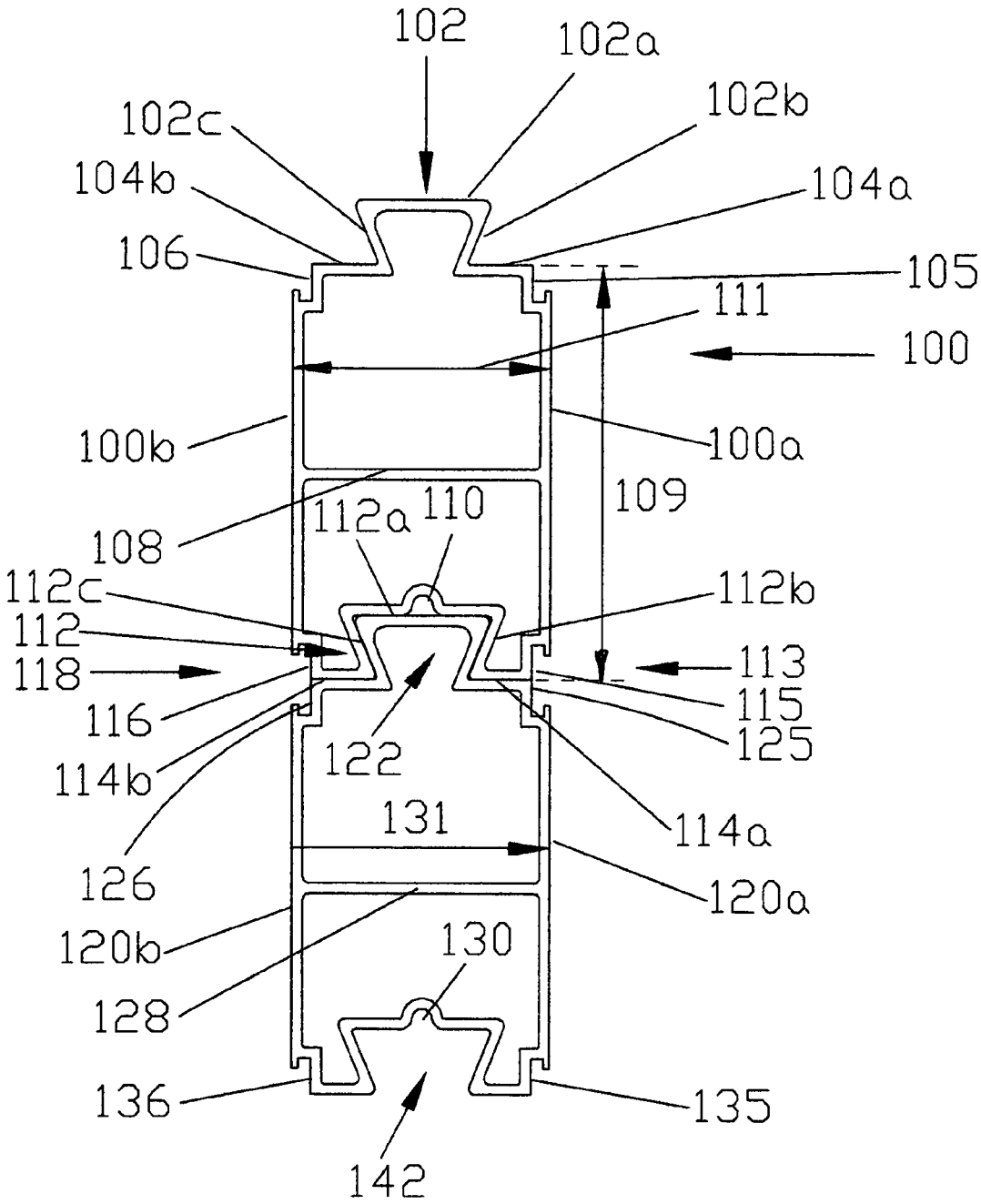
FIG. 2B is a side view of three identical full sized blocks which are used to illustrate the block interlocking affixation which is one of the fundamentals of the wall constructed with the present invention method, wherein the first block is interspaced between two adjacent blocks on the next lower section, and is interlocked to the two blocks through a joinder of an elongated dovetail horizontal channel of the first block and an elongated dovetail horizontal tongue on each of the other two blocks.

Each full sized block 100 is illustrated in FIGS. 2A and 2B to be a hollow structure with a generally rectangular shape, comprising a front vertical side 100*a* and an opposite back vertical side 100*b* which determines a width 111 of the block, a right end 100*c* and left end 100*d* of the block which defines a length 107 of the block, a top front and back surface 104*a* and 104*b*, and a bottom front and back surface 114*a* and 114*b*, wherein the top and bottom front surface 104*a* and 114*a* determines a height 109 of the block. Each block 100 is provided with an elongated tongue 102 and slot or channel 112 on the respective top and bottom surface of the block. The top elongated tongue 102 is located in the center and further extends over the length of the top rectangular surface of the block, which divides the top surface into two symmetrical parts 104*a* and 104*b*. The tongue 102 preferably has a dovetail shape with a top strip surface 102*a* and two sides 102*b* and 102*c* extending at an angle from the top strip surface 102*a* toward each other. The bottom slot or channel 112 also extends over the length of the bottom surface of the block 100, and is located in the center of the bottom surface which divides the bottom surface to be two identical part 114*a* and 114*b*. The slot or channel 112 preferably has a generally dovetail shape with a back surface 112*a*, two sides 112*b* and 112*c* which extend at an angle from the back surface 102*a* toward each other. The back surface 112*a* is further illustrated to have a half circular slot 110 which extends over the length of and further evenly divides the back surface 112*a*.

Further referring to FIGS. 2A and 2B, each block 100 is illustrated to have a top and bottom transverse elongated groove 105 and 115 which are located at the respective top and bottom edge of the front vertical side 100*a*. Similarly, an additional top and bottom transverse elongated groove 106 and 116 is at the respective top and bottom edge of the opposite back vertical side 100*b*. In addition, each block preferably has an interior horizontal wall 108, which is located at the middle of the block 100. The block 100 is preferably made of plastics such as polyurethane which is extruded to form the hollow structure, but it can be made of metal such as aluminum, aluminum alloy, and steel. The block can also be made of wood, however instead of the hollow structure, the wooden block is preferably solid.

The block 120 is illustrated to have a front vertical side and an opposite back side 120*a* and 120*b*, a left end 120*c* and right end 120*d* of the block, a top surface which is divided by a dovetail tongue 122 into two identical portions 124*a* and 124*b*, and a dovetail slot 132 which divides a bottom surface to be two equal part 134*a* and 134*b*. A top and bottom transverse elongated groove 125 and 135 which are located at the respective top and bottom edge of the first vertical side 120*a*, and similar top and bottom transverse elongated groove 126 and 136 are at the respective top and bottom edge of the opposite vertical side 120*b*. Equally, the block 140 has a front vertical side and an opposite side 140*a* and 140*b*, a left end 140*c* and right end 140*d* of the block, a top surface which is divided by a dovetail tongue 142 into two identical portions 144*a* and 144*b*, and a bottom dovetail slot 152 which divides a bottom surface to be two equal portions 154*a* and 154*b*.

The half sized blocks 340, 360, 380 and 400 as illustrated in FIG. 1 have the same structural features as the full sized block 100, except for a shorter length between a right and left end which is the half of the length of the full sized block 100. Therefore, the structural features of the half sized blocks will not be repeated since they follow the order as those structural features which are illustrated for the full sized block 100.

It will be appreciated that with the aid of the dovetail shaped tongue 102 and slot 112, the blocks from the present invention can be easily assembled together as illustrated FIG. 2A, wherein three blocks 100, 120, and 140 are used for illustration. Two blocks 120 and 140 are aligned in series wherein the right end 120*d* of the block 120 connects the left end 140*c* of the block 140. The third block 100 is interspaced on top of the blocks 120 and 140, and further interlocked onto the two blocks 120 and 140 through connection of the dovetail slot 112 of the third block 100 to a half of the dovetail tongue 122 and 142 of the respective blocks 120 and 140 with a sliding operation of the third block 100 to the interspaced position between the two lower blocks. It will be appreciated that a binding material such as adhesive can be injected into the slot 110 after interlocking of the dovetail shaped slot 112 of the block 100 and tongues 122 and 142 of the respective blocks 120 and 140 in the next lower section if a permanent joinder of the blocks is desired.

Referring further to FIGS. 2A and 2B, after interlocking connection of the blocks 100, 120 and 140, the bottom groove 115 at the front side 100*a* of the block 100 matches the top transverse grooves 125 and 145 at the respective front side 120*a* and 140*a* of the respective block 120 and 140 to form a combined groove 113. Similarly, a combined groove 118 is simultaneously formed at the back sides of the blocks. It will be appreciated that the combined grooves 113 and 118 will be extended throughout the interface as illustrated in FIG. 1 if an upper section of the blocks 200, 180, 100 and 360 interlocks into a lower section of the blocks 340, 160, 120 and 140.

Figure 3:
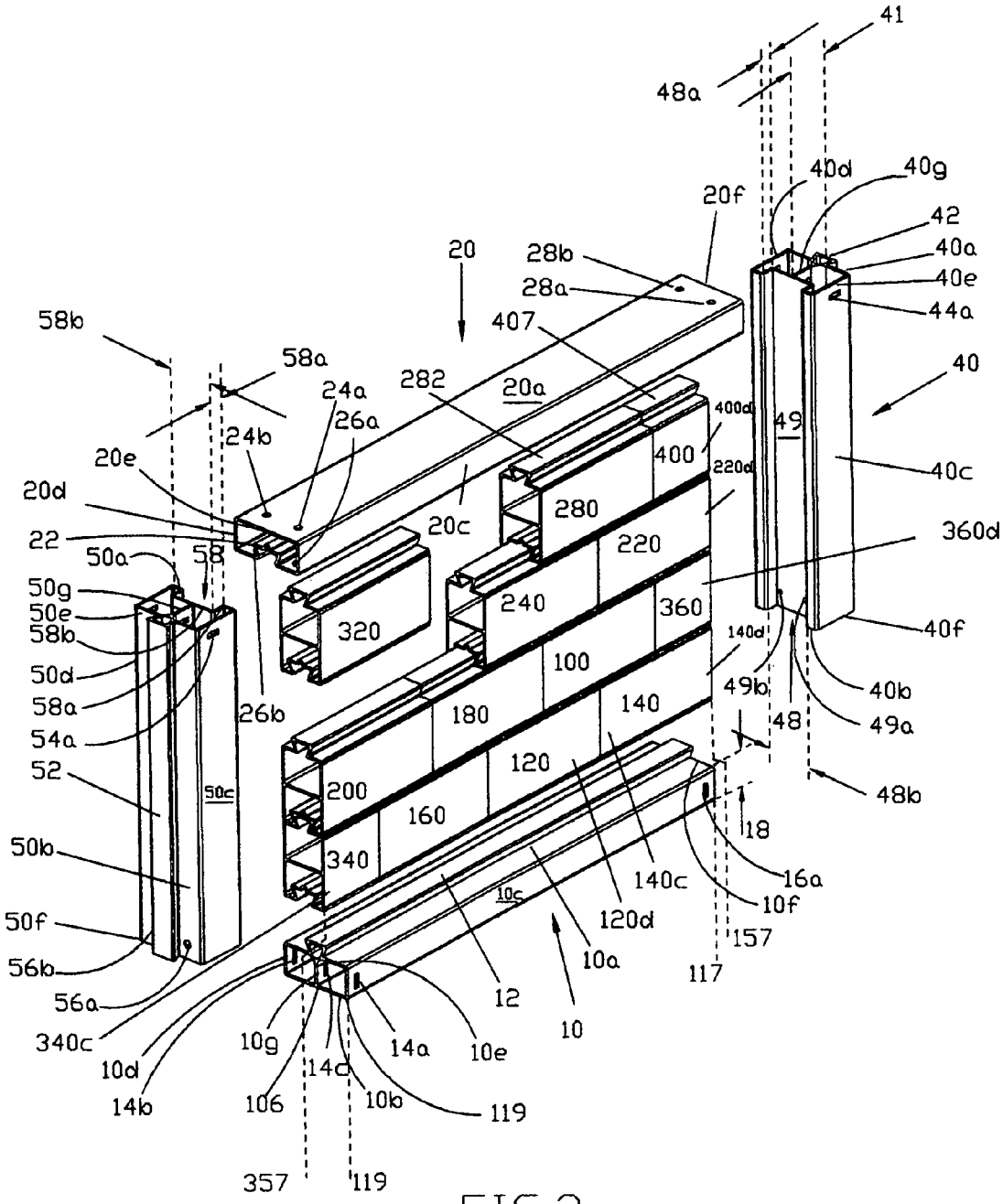
FIG. 3 is a perspective exploded view to illustrate the preferred embodiment plain wall of the present invention method for constructing walls which are the framed block assemblies containing the fundamental structure including the full and half sized blocks, the top and bottom elongated horizontal frame member, and the right and left side vertical frame members.

The bottom horizontal frame member 10 is a generally elongated rectangular hollow rod as illustrated in FIG. 3, comprising a top and bottom horizontal surface 10*a* and 10*b* which determine a thickness 18 of the frame member, a front and back vertical side 10*c* and 10*d*, plus an inner vertical side 10*g* which is placed at the middle of the member and further parallel to the front and back vertical side 10*c* and 10*d*, and a left end 10*e* of the frame member which is remote from a right end 10*f*. A top dovetail tongue 12 is placed on the center of the top horizontal surface so that the tongue 12 extends from the left end 10*e* to the right end 10*f* of the frame member 10. As further illustrated, an opening 14*a*, 14*b* and 14*c* are located on the respective front, back and inner vertical side 10*c*, 10*d* and 10*g* close to the left end 10*e* of the bottom frame member 10. Symmetrically, an opening 16*a*, 16*b* (not shown) and 16*c* (not shown) are located on the respective front, back and inner vertical side 10*c*, 10*d* and 10*g* close to the right end 10*f* of the bottom frame member 10.

The top horizontal frame member 20 is also a generally elongated rectangular hollow rod. As illustrated, the top horizontal frame member 20 is comprised of a top and bottom horizontal surface 20*a* and 20*b*, a front and back vertical side 20*c* and 20*d*, and a left end 20*e* which is remote from a right end 20*f* of the frame member 20. A bottom dovetail slot or channel 22 is placed on the center of the bottom horizontal surface 20*b* which the channel 22 extends from the left end 20*e* to the right end 20*f* of the frame member 20. As further illustrated, two openings 24*a* and 24*b* are located on the top horizontal surface 20*a* close to the left end 20*e* of the frame member 20 and further close to the respective front and back vertical side 20*c* and 20*d*, which are aligned with the respective two openings 26*a* and 26*b* located on the bottom horizontal side 20*b* of the frame member 20. Similarly, an opening 28*a* and 28*b* are located on the top horizontal surface 20*a* close to the respective front and back vertical side 20*c* and 20*d* and further close to the right end 20*f* of the frame member 20, in addition to being aligned with the respective opening 30*a* and 30*b* (both not shown) on the bottom surface 20*b*.

The right side vertical frame member 40 is another hollow rod to having a generally elongated rectangular shape, comprising a right outer and left inner vertical side 40*a* and 40*b*, a front and back vertical sides 40*c* and 40*d* in addition to an inner vertical side 40*g* which is parallel to the vertical sides 40*a* and 40*b* and located at a central position of the frame member, and a top end 40*e* of the frame member which is remote from a bottom end 40*f*. A right side dovetail tongue 42 is placed on the center of the right outer vertical side 40*a* which the tongue 42 extends from the top end 40*e* to the bottom end 40*f* of the frame member 40. In contrast to the tongue 42, a left side rectangular slot or channel 48 is located at the center of the left inner vertical side 40*b* which slot 48 extends from the top end 40*e* to the bottom end 40*f*. The rectangular slot 48 has a depth 48*a* and a width 48*b* which matches the width 111 of the full sized block 100. The slot 48 further comprises a back side 49, from which to the right outer side 40*a*, a central thickness 41 is determined for the right side vertical frame member 40. As further illustrated, an opening 44*a*, 44*b* (not shown) and 44*c* (not shown) are located on the respective front, back and inner vertical side 40*c*, 40*d* and 40*g* close to the top end 40*e* of the frame member 40. Two openings 46*a* and 46*b* (both not shown) are located on the right outer vertical side 40*a* close to the bottom end 40*f* of the frame member 40, and two openings 49*a* and 49*b* are placed on the back side 49 of the rectangular slot 48 close to the bottom end 40*f* and further close to the respective front and back side 40*c* and 40*d*. It will be appreciated that the openings 49*a* and 49*b* are aligned with the respective opening 46*a* and 46*b* (both not shown) on the right side of the frame member.

The left side vertical frame member 50 is a mirror image to the right side vertical frame member 40, comprising a structure of a right inner and left outer vertical side 50*a* and 50*b*, a front, back and inner vertical side 50*c*, 50*d* and 50*g*, and a top end 50*e* of the frame member which is remote from a bottom end 50*f*. A left side dovetail tongue 52 is placed on the center of the left outer vertical side 50*b* which the tongue 52 extends from the top end 50*e* to the bottom end 50*f* of the frame member 50. In contrast to the tongue 52, a right side rectangular slot 58 having a back side 59 (not shown) is located at the center of the right inner vertical side 50*a* which slot or channel 58 extends from the top end 50*e* to the bottom end 50*f*. The rectangular slot 58 has a depth 58*a* and width 58*b* which matches the width 111 of the full sized block 100. As further illustrated, an opening 54*a*, 54*b* (not shown) and 54*c* (not shown) are located on the respective front, back and inner vertical side 50*c*, 50*d* and 50*g* close to the top end 50*e* of the frame member 50. Two openings 56*a* and 56*b* are located on the left outer vertical side 50*b* close to the bottom end 50*f* of the frame member 50 and further close the respective front and back side 50*c* and 50*d*, and two openings 59*a* and 59*b* (both not shown) which are aligned with the respective opening 56*a* and 56*b* are placed on the back side 59 of the rectangular slot 58 close to the bottom end 50*f*.

Figure 4:
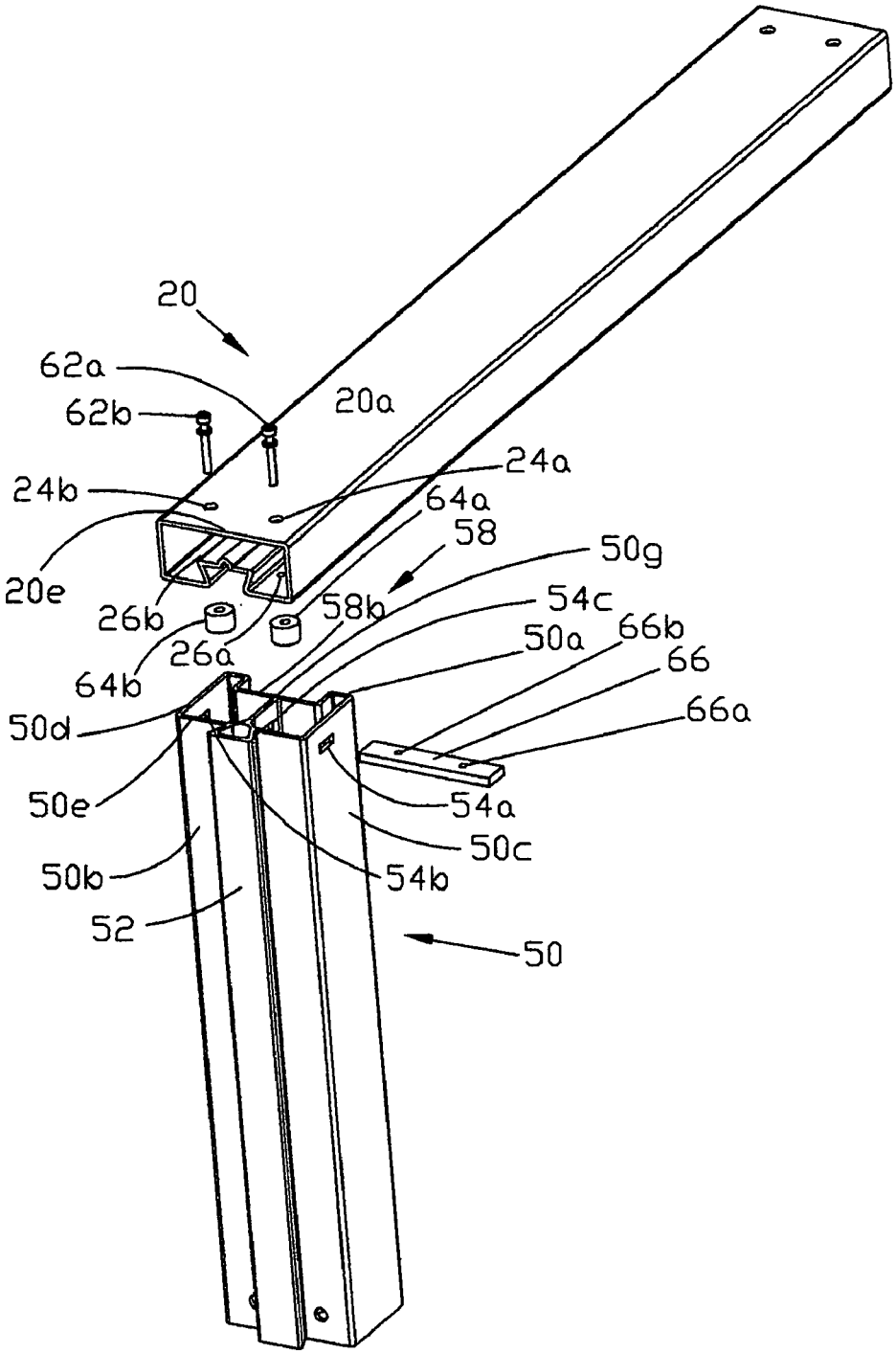
FIG. 4 is a perspective exploded elevational view to illustrate the mechanical connection of the top horizontal and left side vertical elongated frame members to form the upper left corner of the preferred plain wall of the framed block assembly of the present invention method for constructing walls.

FIG. 4 illustrates a first fastener system which is used for affixing the top horizontal frame member 20 and the left side vertical frame member 50 together to form an upper left corner 4 of the preferred framed plain wall 1 of the present invention method for constructing walls. The first fastener system is comprised of a first and second screw 62*a* and 62*b*, a first and second spacer 64*a* and 64*b*, and a horizontal section 66 having two female threaded holes 66*a* and 66*b*. It will be appreciated that during the affixation, the left end 20*e* of the top horizontal frame member 20 is placed on the top of the top end 50*e* of the left vertical frame member 50, and further aligned with the left vertical side 50*b*. The horizontal section 66 is inserted into the holes 54*a*, 54*b*, and 54*c* located close to the top end 50*e* of the left vertical frame member 50, wherein the opening 24*a* and 26*a* on the left end 20*e* of the top horizontal frame member 20 close to the front side 20*a* are aligned with the opening 66*a* on the horizontal section 66. Similarly, the opening 24*b* and 26*b* on the left end 20*e* of the top horizontal frame member 20 close to the back vertical side 20*b* are aligned with the opening 66*b* on the horizontal section 66. The first and second spacer 64*a* and 64*b* are placed between the top of the horizontal section 66 and the bottom surface 20*b* of the top horizontal frame member 20, wherein a center opening of the first spacer 64*a* is aligned with the first threaded hole 66*a* on the horizontal section 66, and the opening 24*a* and 26*a* on the top frame member 20. Similarly a center opening of the second spacer 64*b* is aligned with the second threaded hole 66*b* on the horizontal section 66, and the opening 24*b* and 26*b* on the top frame member 20. Therefore, the first and second screw 62*a* and 62*b* can be connected to the respective first and second threaded hole 66*a* and 66*b* of the horizontal section 66 for affixing the left end 20*e* of the top horizontal frame member 20 to the top end 50*e* of the left side vertical frame member 50, which together form the upper left corner 4 of the framed plain wall 1 of the present invention. It will be appreciated that the upper right corner 6 of the preferred plain wall is affixed in the similar way as that above illustrated. Therefore, the disclosure of the affixation is not repeated.

Figure 5:
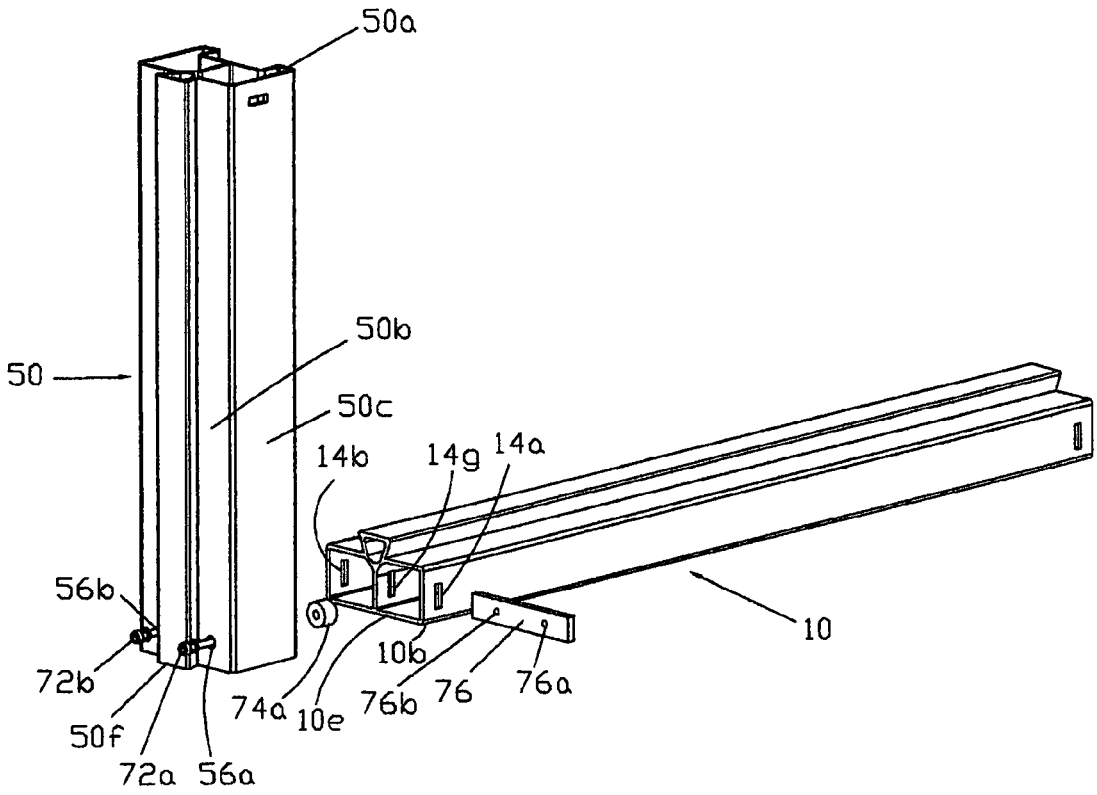
FIG. 5 is a perspective exploded elevational view to illustrate the mechanical connection of the bottom horizontal and left side vertical elongated frame members to form the lower left corner of the preferred plain wall of the framed block assembly of the present invention method for constructing walls.

FIG. 5 illustrates that a second fastener system is used for affixing the bottom horizontal frame member 10 and the left side vertical frame member 50 together to form the lower left corner 5 of the preferred framed plain wall 1 of the present invention. The second fastener system is comprised of a third and fourth screw 72*a* and 72*b*, a third and forth spacer 74*a* and 74*b* (not shown), and a horizontal section 76 having two female threaded holes 76*a* and 76*b*. It will be appreciated that during the affixation, its bottom surface 10*b* of the bottom horizontal frame member 10 is aligned with the bottom end 50*f* of the left vertical frame member 50, and its left end 10*e* further contacts the right inner side 50*a* of the vertical frame member 50. The horizontal section 76 is then inserted into the holes 14*a*, 14*b*, and 14*g* located close to the left end 10*e* of the bottom frame member 10, wherein the opening 56*a* and 58*a* (not shown) close to the front side 50*c* and further close to the bottom 50*f* of the left vertical frame member 50 are aligned with the opening 76*a* on the horizontal section 76. Similarly, the opening 54*b* and 58*b* close to the bottom end 50*f* of the left vertical frame member 50 and further close to the back vertical side 50*d* are aligned with the opening 76*b* on the horizontal section 76. The third spacer 74*a* is placed between the left side of the horizontal section 76 and the right side 50*a* of the left vertical frame member 50, wherein a center opening of the third spacer 74*a* is aligned with the first threaded hole 76*a* on the horizontal section 76, and the opening 56*a* and 58*a* on the vertical frame member 50. Equally, a central opening of the fourth spacer 74*b* (not shown) is aligned with the second threaded hole 76*b* on the horizontal section 76, and the opening 56*b* and 58*b* on the vertical frame member 50. Therefore, the third and fourth screw 72*a* and 72*b* extends through the respective holes of 56*a* and 58*a* in a group and 56*b* and 58*b* in an another group can be connected to the respective first and second threaded hole 76*a* and 76*b* of the horizontal section 76 for affixing the left end 10*e* of the bottom horizontal frame member 10 to the bottom end 50*f* of the left side vertical frame member 50, which form the lower left corner 5 of the framed plain wall 1 of the present invention method for constructing walls. It will be appreciated that the lower right corner 7 of the preferred plain wall 1 is affixed in the similar way as the above illustrated. Therefore, disclosure of the affixation is not repeated. It will be further appreciated that at least two openings can be constructed on the top horizontal frame member, the horizontal means, the left and right side vertical frame members for affixation of the block assembly, in accordance with the spirit and scope of the present invention.

Referring to FIGS. 1 to 5, a new method from the present invention to construct the preferred plain wall 1 is illustrated as follows. First the method provides a plurality of the full sized blocks 100, 120, 140, 160, 180, 200, 220, 240, 260, 280, 300, and 320, and multiple half sized blocks 340, 360, 380 and 400. The method also provides the bottom and top horizontal frame member 10 and 20, and the right and left vertical frame members 40 and 50, wherein the bottom horizontal frame member 10 is first placed to lie horizontally with the bottom surface 10*b* contacting the ground, and the right and left end 10*f* and 10*e* are placed at a respective position 117 and 119 of the ground.

The method then provides a procedure to assemble a block assembly, which is the body of the wall. In the procedure, the full sized block 140 is first affixed to the top of the bottom frame member 10 through the interlocking of the block dovetail slot or channel 152 to the frame member dovetail channel 12. As illustrated in FIGS. 1 and 3, the right end 140*d* of the block is placed over the position 117 and extended to a position 157, wherein a length between the position 117 and 157 is slightly less than the depth 48*b* of the rectangular slot 48 of the right vertical side frame member 40. It will be appreciated that the length which the block 140 is placed over for an additional procedure of the method to frame the right vertical frame member 40 to a right side of the block assembly including the right end 140*d* of the block 140 being inserted into the rectangular slot 48 of the right side vertical frame member 40 is the same. It will be further appreciated that the affixation of the block 140 is through sliding the block 140 right to the position 157 after the dovetail slot or channel 152 of the block 140 matches the dovetail tongue 12 at the left end 10*e* of the horizontal bottom frame member 10. As illustrated previously, if the permanent wall is desired, the adhesive is injected into the half round slot 150 of the block 140 to permanently join the block 140 and the frame member 10. Following the same procedure, the second full sized brick 120 is interlocked to the frame member 10 and further placed adjacent to the block 140, wherein the right end 120*d* of the block 120 contacts the left end 140*c* of the block 140. Therefore, repeating the above procedure, a first section 1*a* which is the lowest part of the body of the plain wall 1 is completed after the third full sized block 160 is placed to contact the second block 120, and a half sized block 340 is positioned to follow the block 160. It will be appreciated that the left end 340*c* of the half sized block 340 in the first section 1*a* of the blocks aligns a position 357 which is over the position 119 where the left end 10*d* of the bottom frame member 10 is positioned. It will be appreciated that a length between the position 119 and 357 is slightly less than the depth 58*a* of the rectangular slot 58 of the left vertical side frame member 50 which is for installation of the block end 340*c* into the slot 58 of the left vertical frame member.

It will be also appreciated that a second section 1*b* of the blocks from the present invention method for constructing walls can be completed following the same procedure which is illustrated above for assembling the first section 1*a* of the blocks, wherein the second section of the blocks starts from a half sized block 360 followed by the full sized blocks 100 and 180 in series, and ends at the full sized block 200. As illustrated in FIGS. 1 and 3, the half sized block 360 is placed on the top and further interlocked to the full sized block 140 in the next lower section, wherein the right end 360*c* of the half sized block 360 is vertically aligned with the right end 140*c* of the block 140. The full sized block 100 next to the block 360 is placed to interspace on the top of the respective blocks 140 and 120 in the next lower section of the blocks, and further interlock the blocks 140 and 120 which is illustrated in detail from FIG. 2A. The blocks of 180 and 200 are placed in the same way as that of the block 100. Therefore, the left end 200*c* of the block 200 at the end of the second section 1*b* vertically aligns the left end 340*c* of the half sized block 340 in the first section 1*a* of the wall. It will be further appreciated that the third and forth section 1*c* and 1*d* of the block assembly can be completed in accordance with the present invention method for constructing walls, wherein the third section starts in the order the full sized blocks 220, 240 and 260 and ends with the half sized block 380. The forth section begins in the order the half sized block 400, the full sized block 280 and 300 and finishes at the full sized block 320.

Referring to FIGS. 1 and 3 again, after the step of assembling blocks to form the body of the framed plain wall 1 from the present invention method, the left end 340*c*, 200*c*, 380*c* and 320*c* of the respective first, second, third and fourth section 1*a*, 1*b*, 1*c* and 1*d* of blocks are all aligned together, and further match the rectangular slot 58 of the left side vertical frame member 50. Similarly, the right end 140*d*, 360*d*, 220*d* and 400*d* of the respective first, second, third and fourth section of the blocks are aligned together, and further match the rectangular slot 48 of the right side vertical frame member 40.

The method for constructing walls from the present invention now turns to a step of framing the body of the plain wall. The left and right vertical frame member 50 and 40 are pressed towards the respective left and right end 10*e* and 10*f* of the bottom frame member 10, wherein the rectangular slot 58 of the left side vertical frame member 50 covers the left end 340*c*, 200*c*, 380*c* and 320*c* of the respective blocks on the left side of the wall body, and the bottom end 50*f* of the left vertical frame member 50 matches the bottom horizontal surface 10*b* of the bottom frame member 10. Similarly, the rectangular slot 48 of the right side vertical frame member 40 covers the right end 140*d*, 360*d*, 220*d* and 400*d* of the respective blocks on the right side of the wall body, and the bottom end 40*f* of the right vertical frame member 40 matches the bottom horizontal surface 10*b* of the bottom frame member 10. The top horizontal frame member 20 is slid into place on the top end 50*e* and 40*e* of the respective left and right side vertical frame member 50 and 40, wherein the right and left end 20*f* and 20*e* of the top frame member 20 matches the respective right and left vertical side 40*a* and 50*b* of the respective right and left vertical member 40 and 50, and the bottom dovetail slot or channel 22 of the top frame member 20 matches the top dovetail tongues 402, 282, 302 and 320 (both not shown) of the respective block 400, 280, 300 and 320 in the fourth block section 1*d*. It will be appreciated that the right and left side vertical frame members 40 and 50 have the same length which is equal to the combined height from four blocks having the individual height 109 plus the thickness 18 of the bottom horizontal frame member 10, and the top horizontal frame member 20 has a length which is equal to the length of three and half blocks having the individual length 107 plus twice the central thickness 41 of the vertical frame member 40. The framed plain wall 1 is completed after affixing each of four corners 4, 5, 6 and 7, wherein the method of affixation is illustrated in FIGS. 4 and 5.

Figure 11:
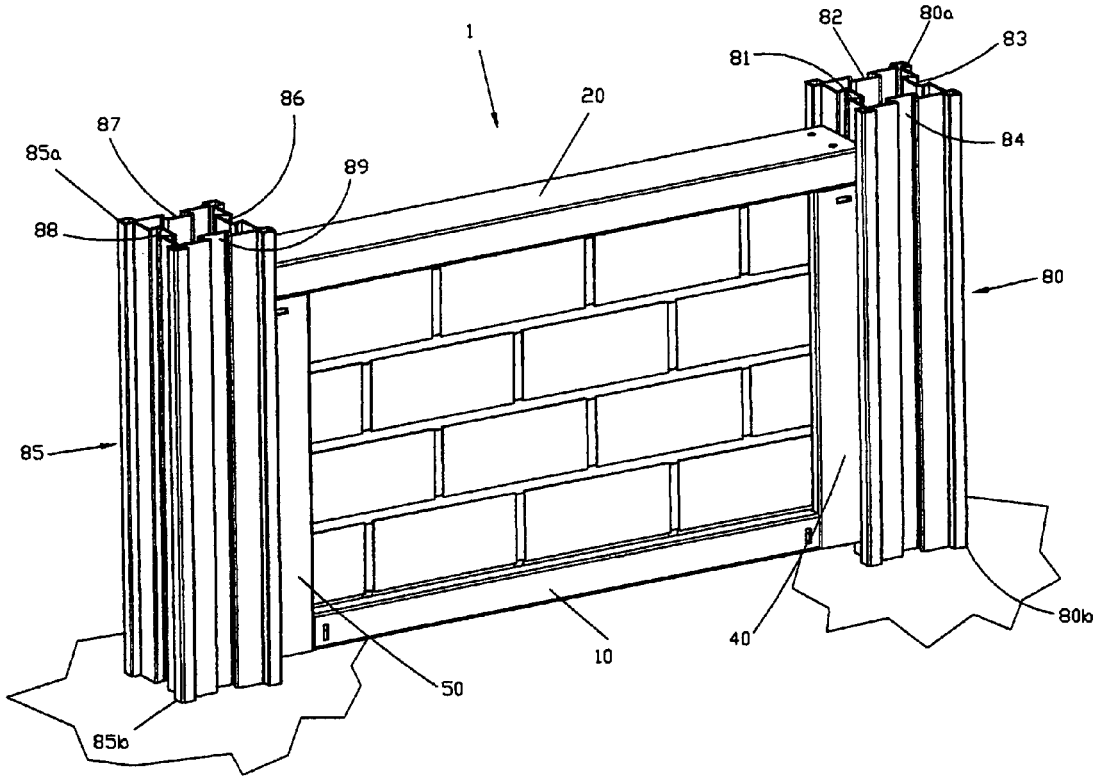
FIG. 11 is a perspective view to illustrate that the plain wall from the present invention method for constructing walls can be permanently installed into the ground through an additional right and left side vertical post which are affixed into the ground and further interlocked to the respective the right and left side vertical frame members of the plain wall.
Figure 12:
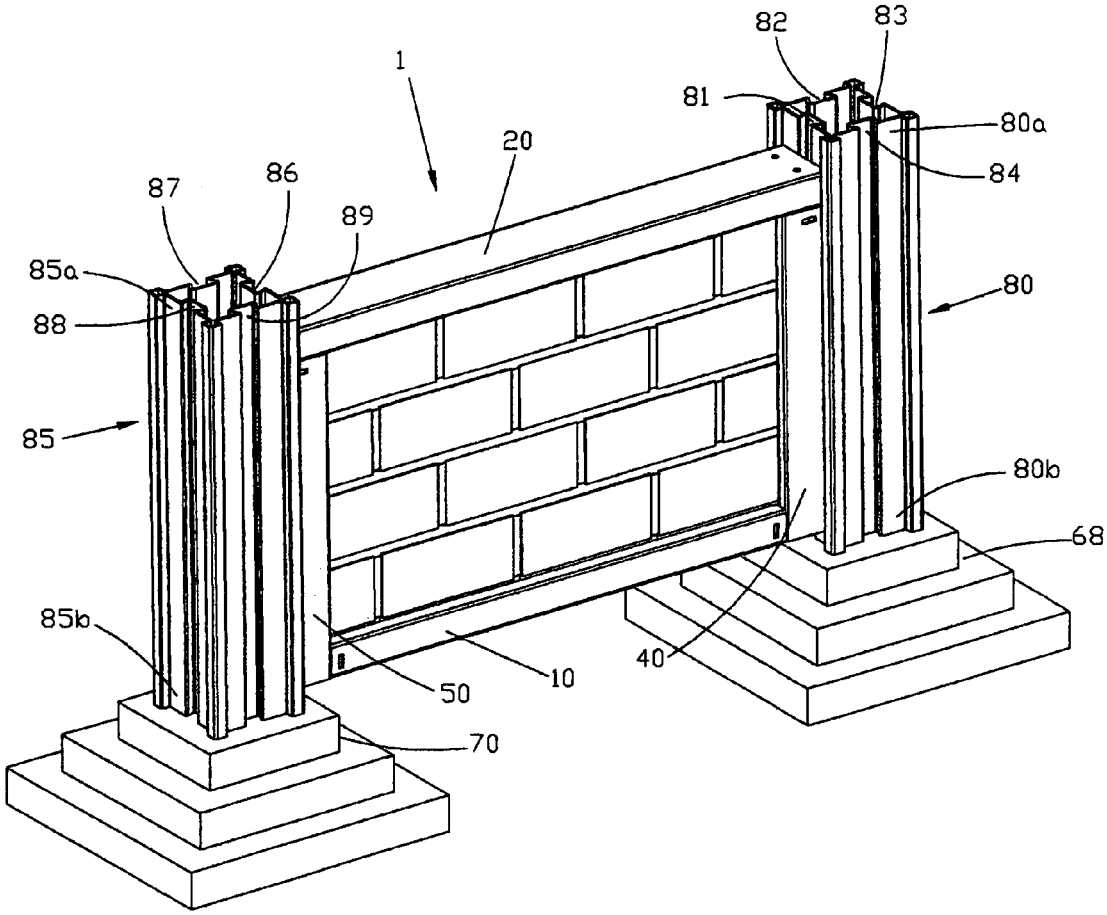
FIG. 12 is a perspective view to illustrate that the plain wall from the present invention method for constructing walls can be temporarily placed on the ground through a right and left side vertical post which are affixed into the respective heavy support means and interlocked to the respective the right and left side vertical frame members of the plain wall.

Referring to FIGS. 11 and 12, there is an illustrated installation of the framed plain wall 1, which is the last step of the present invention method for constructing walls. As illustrated an additional identical right and left side vertical post 80 and 85 are introduced for the framed wall installation. The right side vertical post 80 is generally an elongated cubic hollow rod, comprising a top and bottom end 80*a* and 80*b*, and four identical vertical dovetail slots or channels 81, 82, 83 and 84 which are respectively placed on the center of each identical vertical side of the post 80 with each of the slots extending from the top end 80*a* to the bottom end 80*b* of the vertical post 80, and further matches the dovetail tongue 42 on the right outer side of the right side vertical frame member 40. Similarly the left side vertical post 85 is comprised of a top and bottom end 85*a* and 85*b*, and four identical vertical dovetail slots 86, 87, 88 and 89 are respectively placed on the center of each identical vertical side of the post 85 wherein each of the slots extends from the top end 85*a* to the bottom end 85*b* of the vertical post 85, and further matches the dovetail tongue 52 on the left outer side of the left side vertical frame member 50.

The right and left side vertical post 80 and 85 at the respective bottom end 80*b* and 85*b* can be permanently affixed onto or into the ground, as illustrated in FIG. 11, from which the framed plain wall 1 can be securely installed to the ground through sliding the right and left side dovetail channel 42 and 52 of the plain wall 1 into the respective dovetail slot 81 and 86 of the respective right and left vertical post 80 and 85. In contrast to the permanent affixation of the vertical posts shown in FIG. 11, the right and left side vertical post 80 and 85 at the bottom end 80*b* and 85*b* can be affixed into a respective right and left side supporter 68 and 70, as illustrated in FIG. 12. It will be appreciated that the right and left side supporter 68 and 70 preferably have a heavy mass and a large bottom surface for achieving stability of the framed plain wall 1 after its installation.

As depicted throughout FIG. 6, there is an illustrated another preferred embodiment 2 wall with mortar from the present invention method for constructing walls. The alternative preferred embodiment 2 of the wall with mortar includes a plurality of the full sized blocks such as 100 and four half sized blocks as 340, the right and left vertical frame member 40 and 50, the top and bottom horizontal frame member 20' and 10', a plurality of the identical vertical inserts of 500, 520, 540, 560, 580, 600, 620, 640, 660, 680, 700 and 720 which act as the vertical mortar, and multiple identical elongated horizontal inserts 740, 760, 780, 800, 820 and 840 for the horizontal mortar.

Figure 7A:
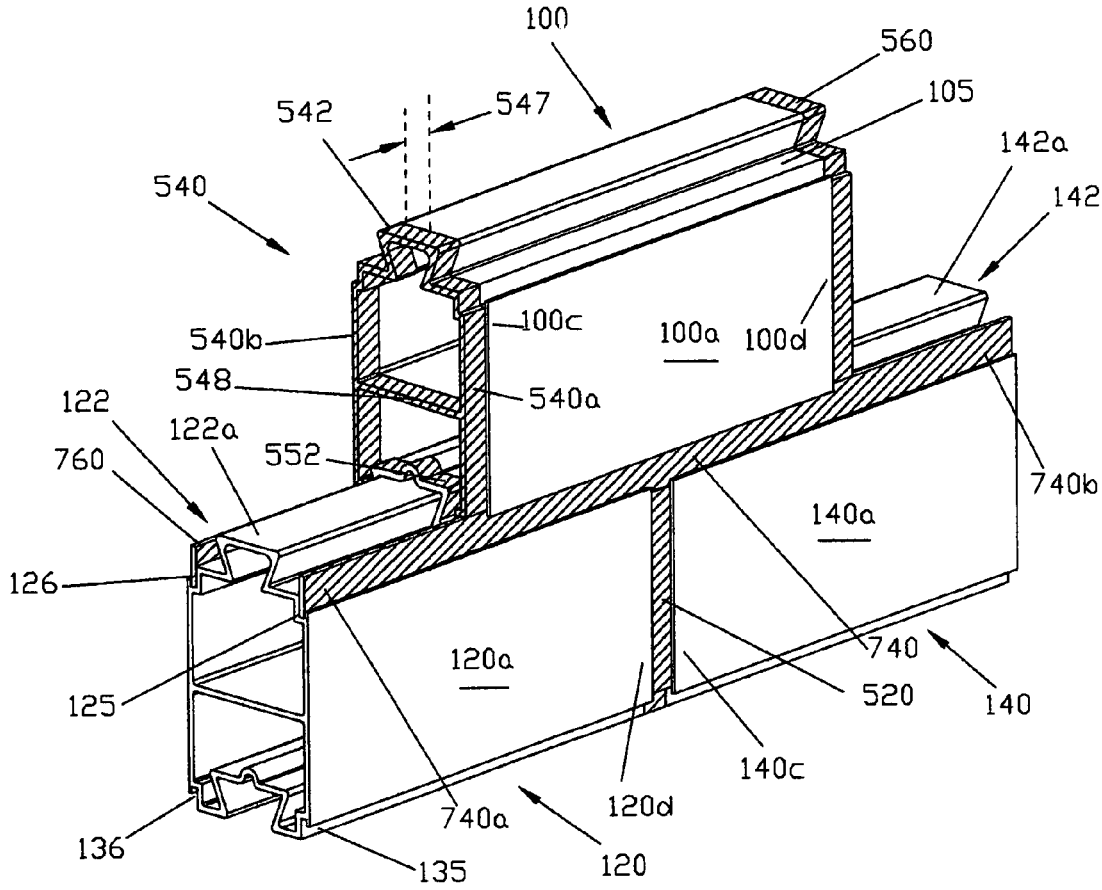
FIG. 7A is a perspective view of three identical full sized blocks and vertical inserts with the vertical and horizontal inserts which are used to illustrate the block interlocking affixation and application of the inserts to simulate the mortar from another preferred embodiment of the present invention method to construct walls.
Figure 7B:
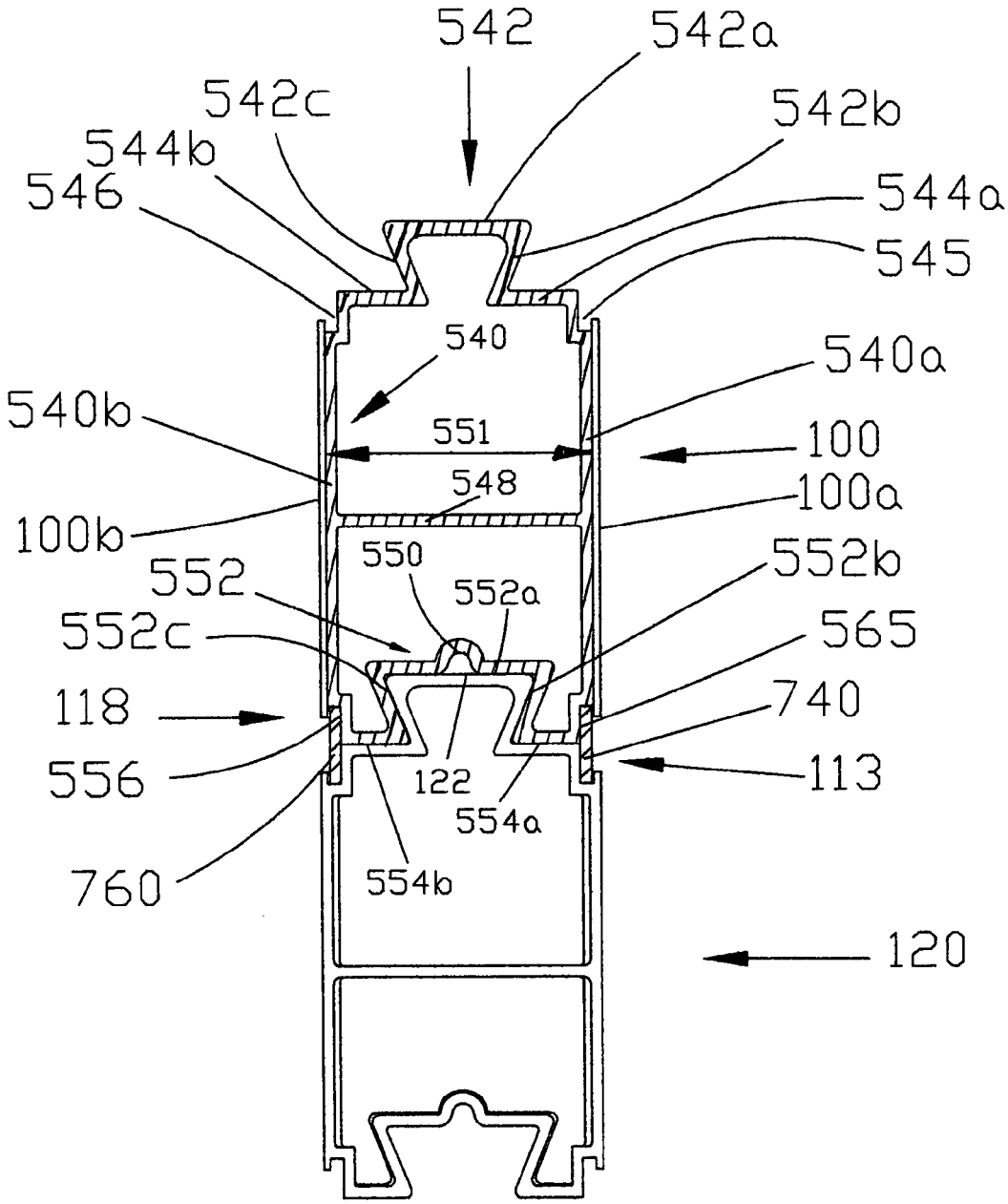
FIG. 7B is a side view of three identical full sized blocks with the vertical and horizontal inserts which are illustrated in FIG. 7A.

Referring to FIGS. 7A and 7B, the vertical insert 540 is a flat structure with a narrow thickness 547 which has the structural features identical to those of the block 100 except for having a recess width 551, and different color or different texture or both. The inserter 540 comprises a front vertical strip 540*a* and an opposite back vertical strip 540*b* which determine the width 551 of the inserter, a top front and back strip 544*a* and 544*b*, a bottom front and back strip 554*a* and 554*b*, and a middle horizontal strip 548. The insert 540 is designed to provide a dovetail shaped outer and inner structure 542 and 552 on the respective top and bottom strip of the insert. The top outer dovetail structure 542 is located at the center of the top of the insert, which divides the top into two symmetric strips 544*a* and 544*b*. The top outer dovetail shaped structure 542 has a top strip 542*a* and two side strips 542*b* and 542*c* which extends at an angle from the top strip 542*a* toward each other. The bottom inner dovetail shaped structure 552 is located in the center of the insert bottom which divides the bottom strip into two identical part 554*a* and 554*b*. The bottom inner dovetail shaped structure 552 has a top strip 552*a*, two side strips 552*b* and 552*c* which extend at an angle from the top strip 552*a* toward each other. The top strip 552*a* is further illustrated to have a half circle strip 550 which further divides the back strip 552*a*.

Each vertical insert 540 is illustrated to further have a top and bottom transverse elongated groove 545 and 565 which are located at the respective top and bottom edge of the front vertical strip 540*a*. Similarly additional top and bottom transverse elongated groove 546 and 556 is at the respective top and bottom edge of the opposite back vertical strip 540*b*. Each vertical insert is preferably made of plastic which is extruded to form a hollow structure, but it can be made of other lightweight materials. The vertical insert can also be made of wood, however instead of the hollow structure, the wooden insert is preferably solid. Each horizontal insert 740 is an elongated strip, comprising the right end 700*a* and left end 700*b*, and is preferably made of plastics, or other lightweight materials.

FIGS. 7A and 7B illustrate how the fundamental structure of the blocks 100, 120 and 140, the vertical inserts 520, 540 and 560, and the horizontal inserts 740 and 760 is assembled to form a basic unit of the wall with mortar from the present invention method for constructing walls. In the assembling process, two blocks 120 and 140 are aligned in series wherein the vertical insert 520 is placed between two blocks to contact the respective right end 120*d* of the block 120 and the left end 140*c* of the block 140, and the top strip 522*a* of the dovetail structure 522 of the inserter further simultaneously aligns both top surface 102*a* of the dovetail tongue 122 of the block 120 and the top surface 142*a* of the top dovetail tongue 142 of the block 140. The third block 100 is interspaced on the top of the block 120 and 140, and further interlocks the two blocks 120 and 140 and the vertical insert 520 through connection of the bottom dovetail channel 112 of the third block 100 to a part of the top dovetail tongues 122 and 142 of the respective blocks 120 and 140 and the top outer dovetail structure 522 of the vertical insert 520 after sliding the third block 100 to the interspaced position. It will be appreciated that the adhesive can be injected into the half round slot 110 to permanently join the upper block 100 to the block 120, the insert 520 and block 140 in the next lower section if the permanent joinder is desired.

Following the sliding operation another vertical insert 560 is then to connect the respective right end 100*d* of the block 100, wherein the bottom inner dovetail shaped structure 572 of the insert 560 matches the dovetail tongue 142 of the block 140 in the next section. Similarly, an additional vertical insert 540 is then slid to connect the respective left end 100*c* of the block 100, wherein the bottom inner dovetail structure 552 of the insert 540 matches the dovetail tongue 122 of the block 120 in the next section. The horizontal inserts 740 and 760 are illustrated to insert into the respective front and back side combined groove 113 and 118, which are illustrated in FIGS. 2A and 2B. FIG. 7B shows the side view of the assembly introduced in FIG. 7A, which particularly illustrates the recess width "W" 551 of the vertical insert 540, which makes the front and back vertical strip 540*a* and 540*b* of the vertical insert 540 perfectly match the horizontal insert 740 which is placed in the front side combined groove 113 and the other horizontal insert 760 placed in the back side combined groove 118. Therefore the vertical inserts 540, 560 and 520 can act as the vertical mortar, and the horizontal inserts 740 and 760 can act as the horizontal mortar for ornamentation.

Figure 8:
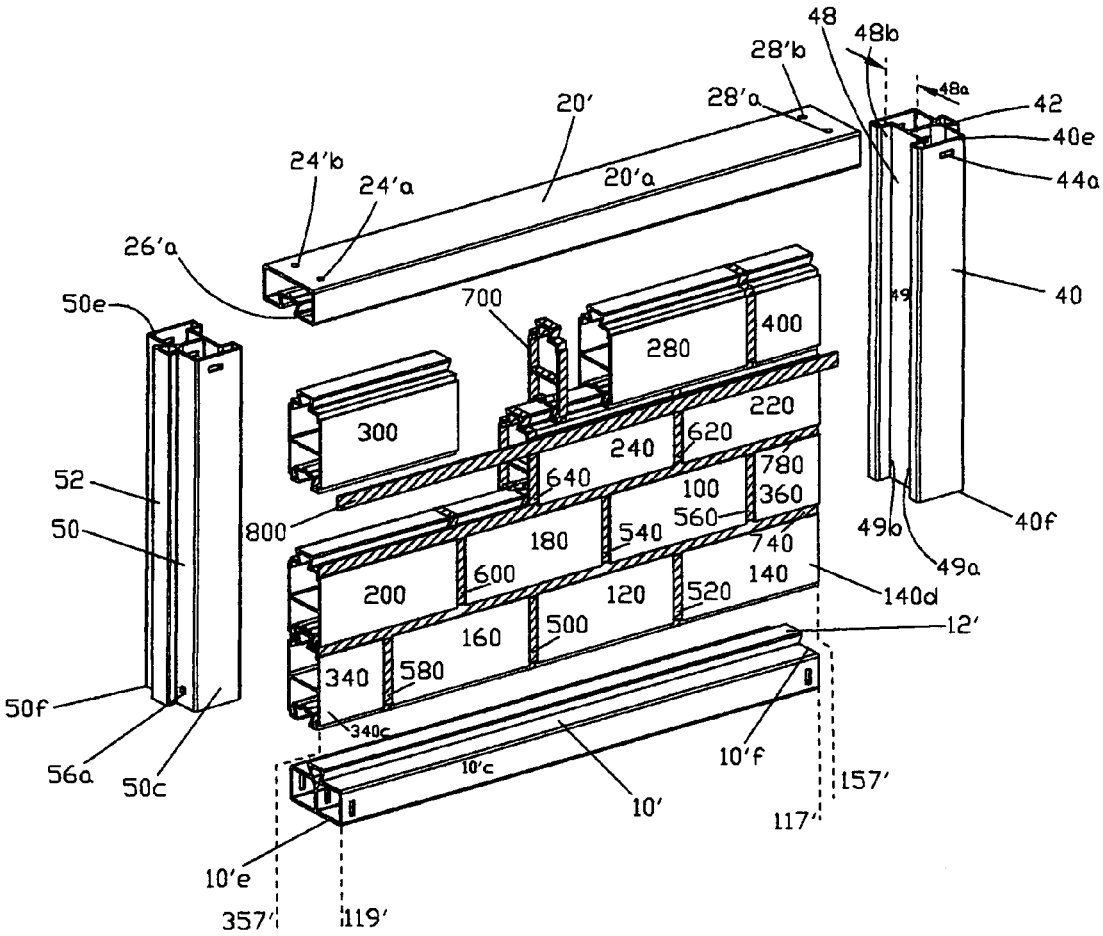
FIG. 8 is a perspective exploded view to illustrate another preferred embodiment wall with mortar from the present invention method for constructing walls, wherein this preferred embodiment includes the full and half sized blocks, the vertical and horizontal inserts to simulate the mortar, the top and bottom elongated horizontal frame member, and the right and left side vertical frame members.

Referring to FIGS. 6 to 8, a new method to construct the preferred wall with mortar is illustrated as follows. First the method provides a plurality of the full sized blocks 100, 120, 140, 160, 180, 200, 220, 240, 260, 280, 300, and 320, four half sized blocks 340, 360, 380 and 400, a plurality of the identical vertical inserts 500, 520, 540, 560, 580, 600, 620, 640, 660, 680, 700 and 720 which act as the vertical mortar, and multiplicity of identical horizontal inserts of 740, 760, 780, 800, 820 and 840 for use as the horizontal mortar. The method also provides the bottom and top horizontal frame members 10' and 20', and the right and left vertical frame member 40 and 50, wherein the bottom horizontal frame member 10' is first placed to lie horizontally with the bottom surface 10'*b* contacts the ground, and the right and left ends 10'*f* and 10'*e* are placed at the respective position 117' and 119' of the ground.

A procedure is then provided from the present invention method to assemble the blocks and inserts of the wall with mortar. It will be appreciated that the procedure will be the same as that illustrated for assembling the block assembly of the plain wall 1 in accordance with FIGS. 1-3, except that each block and vertical insert are alternatively installed wherein installation of the vertical insert is illustrated in FIGS. 7A and 7B. Therefore the procedure to assemble the block and insert assembly is the same. In the procedure, the full sized block 140 is first affixed to the top surface 10'*a* of the frame member 10' through the interlocking of the block dovetail slot to the frame member dovetail tongue 12'. As illustrated in FIG. 8, the right end 140*d* of the block is placed over the position 117' and extended to a position 157', wherein a length between the position 117' and 157' is slightly less than the depth 48*b* of the rectangular slot 48 of the right vertical side member 40. Following the known procedures, a first section 2*a* of the block and vertical inserter assembly is completed, comprising in order the first block 140 at the right end of the section, the first vertical insert 520, the second block 120, the second vertical insert 500, the third block 160, the third vertical insert 580 and the half sized block 340 at the right end of the section 2*a*. The left end 340*c* of the half sized block 340 aligns a position 357' which is over a position 119' where the left end 10'*d* of the bottom horizontal frame member 10' is positioned. It will be appreciated that a length between the position 119' and 357' is slightly less than the depth 58*a* of the rectangular slot 58 of the left vertical side frame member 50 for installation of the block wall into the left vertical frame member 50.

It will also be appreciated that a second section 2*b* of the block and vertical insert assembly can be completed following the procedure for constructing the first section 2*a* of the assembly. The second section 2*b* includes in order that half sized block 360, the vertical insert 560, the full sized block 100, the vertical insert 540, the full sized block 180, the vertical insert 600, and the full sized block 200. As illustrated in FIG. 8, the right end 360*d* of the half sized block 360 is vertically aligned with the right end 140*d* of the block 140 in the first block section. Each full sized block such as 100 is also interspaced on the top of two respective blocks such as 140 and 120 in the lower first section of the wall, and further interlocked to the two blocks as illustrated in FIGS. 7A and 7B. The left end 200*c* of the block 200 in the second section 2*b* vertically aligns the left end 340*c* of the half sized block 340 in the first section of the wall. The horizontal insert 740 acts as the horizontal mortar and is therefore able to inserted into the front side combined groove 118 shown in FIGS. 2A and 2B which extends throughout the section. Similarly, the other horizontal insert 760 also acts as the horizontal mortar and is installed into the combined groove 119 shown in FIGS. 2A and 2B on the back side of the blocks 360, 100, 180 and 200. Up to this point, the first section 2*a* of the block and vertical insert assembly is completed for addition of the horizontal insert. Following the same procedures described for the first section 2*a* of the block and both the vertical and horizontal insert assemblies, the remaining part of the body of the wall with mortar can be completely assembled, which is illustrated in FIG. 6.

In the step of framing the body of the wall with mortar 2, the procedures are the same as those illustrated for framing the plain wall 1. It will be appreciated that the right and left side vertical frame member 40 and 50 have the same length which is equal to the combined heights of four blocks having the individual height 109 plus the thickness 18 of the bottom horizontal frame member 10'. The top horizontal frame member 20' has a length which is equal to the length of three and half blocks having the individual block length 107, plus the combined thicknesses of three vertical inserts having the individual thickness 547, and further plus twice the central thickness 41 of the vertical frame member 40. The bottom horizontal frame member 10' has a length which is equal to the length of three and half blocks having the individual block length 107, plus the combined width of three vertical inserts, and further less twice depths 48*a* of the rectangular slot 48 of the vertical frame member 40. The alternative preferred embodiment 2 of the framed wall with mortar is completed after affixing each of four corners 4', 5', 6' and 7', wherein the method of affixation is the same as that illustrated in FIGS. 4 and 5.

In terms of the details for the last step to install the framed wall with mortar of the present invention method, each of the installation processes will be the same as that illustrated in FIGS. 11 and 12 for installing the plain wall 1.

Figure 13A:
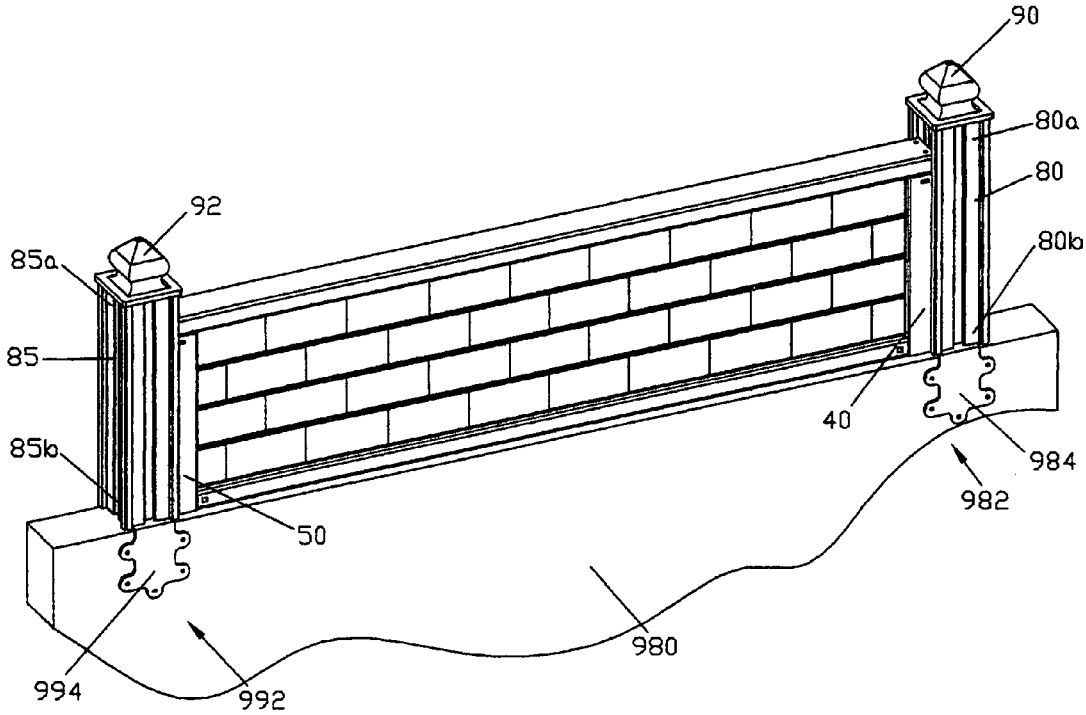
FIG. 13A is a perspective view to illustrate that the wall with mortar from the present invention method for constructing walls can be securely installed to the top of an existing structure through an additional right and left side vertical post which are affixed onto an existing structure and further interlocked with the respective right and left side vertical frame member of the wall.
Figure 13B:
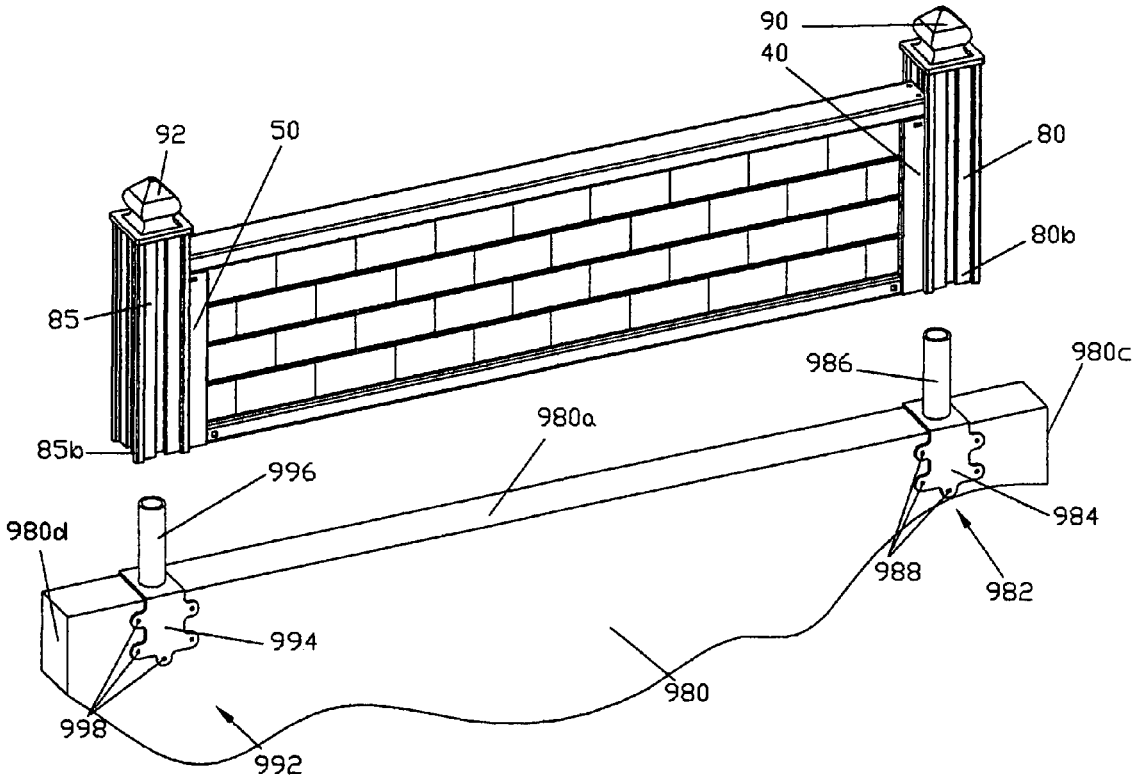
FIG. 13B is a perspective exploded view to illustrate that the framed wall with mortar can be securely installed to the top of an existing structure shown in FIG. 13A. The exploded view illustrates that the wall with mortar which interlocked with the respective additional right and left side vertical posts is ready for an insertion operation in installation of the wall to the existing structure, wherein two support means are affixed onto the existing structure.
Figure 14:
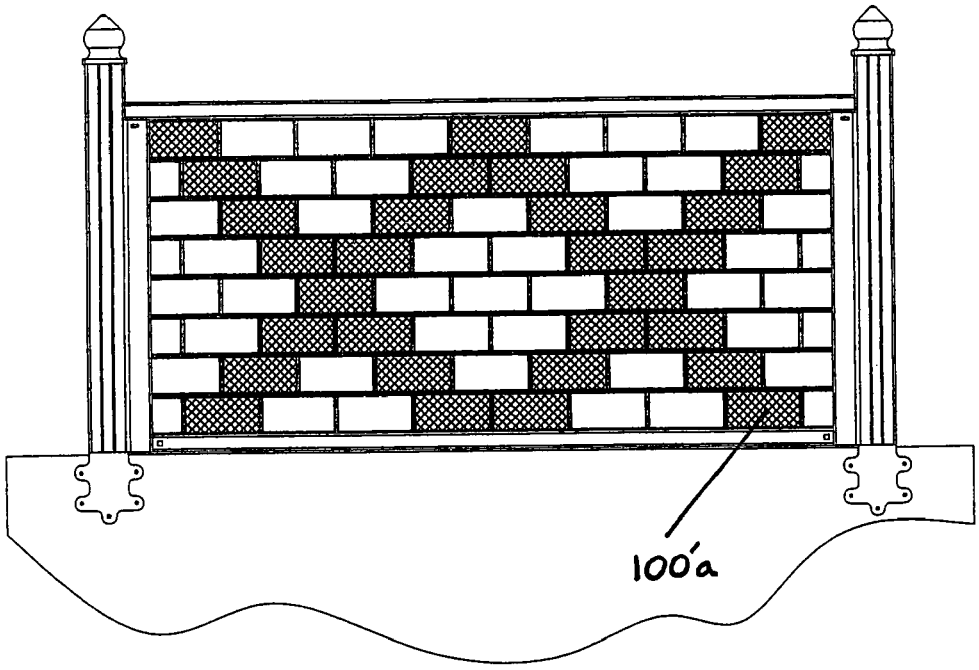
FIG. 14 is a front view to illustrate one variation of the pattern of the wall with mortar, wherein the wall with mortar is securely installed to the top of an existing structure.
Figure 15:
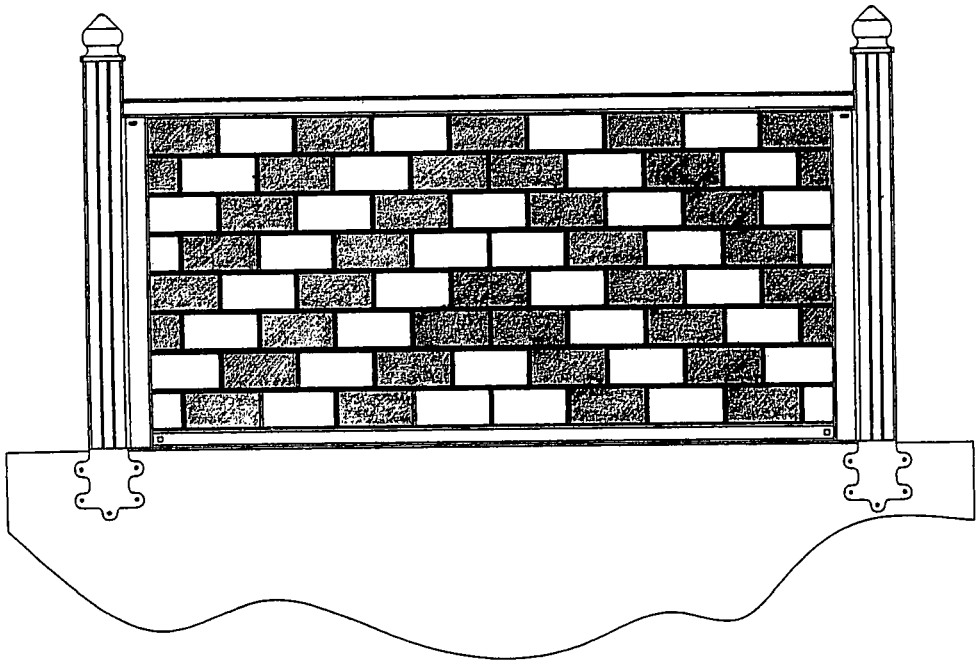
FIG. 15 is a front view to illustrate another variation of the pattern of the wall with mortar, wherein the wall with mortar is securely installed to the top of an existing structure.
Figure 16:
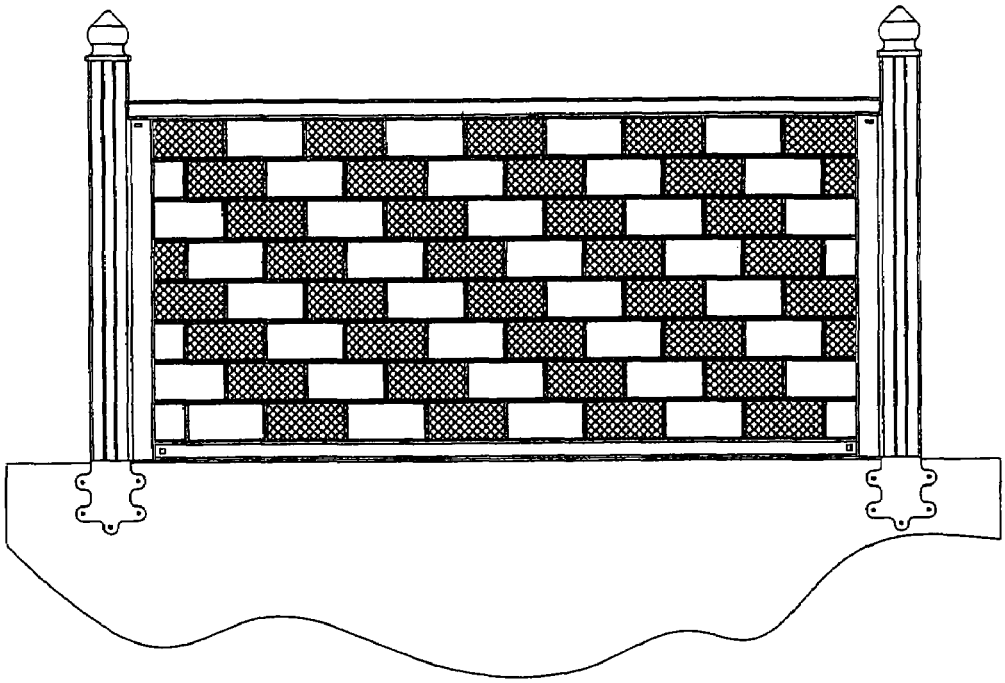
FIG. 16 is a front view to illustrate an additional variation of the pattern of the wall with mortar, wherein the wall with mortar is securely installed to the top of an existing structure.
Figure 17:
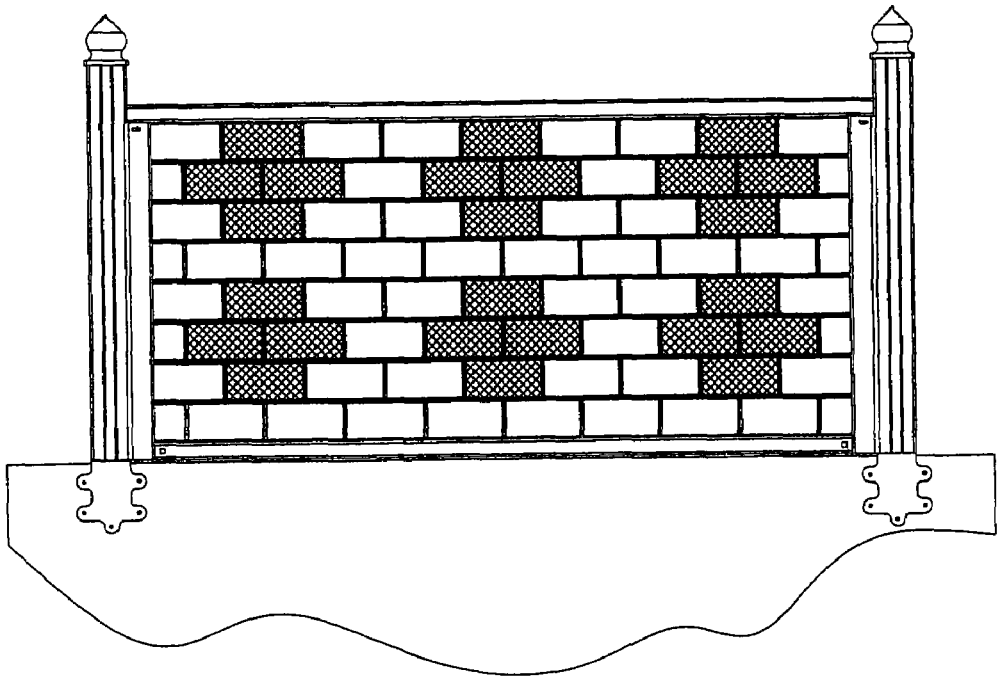
FIG. 17 is a front view to illustrate another additional variation of the pattern of the wall with mortar, wherein the wall with mortar is securely installed to the top of an existing structure.
Figure 18:
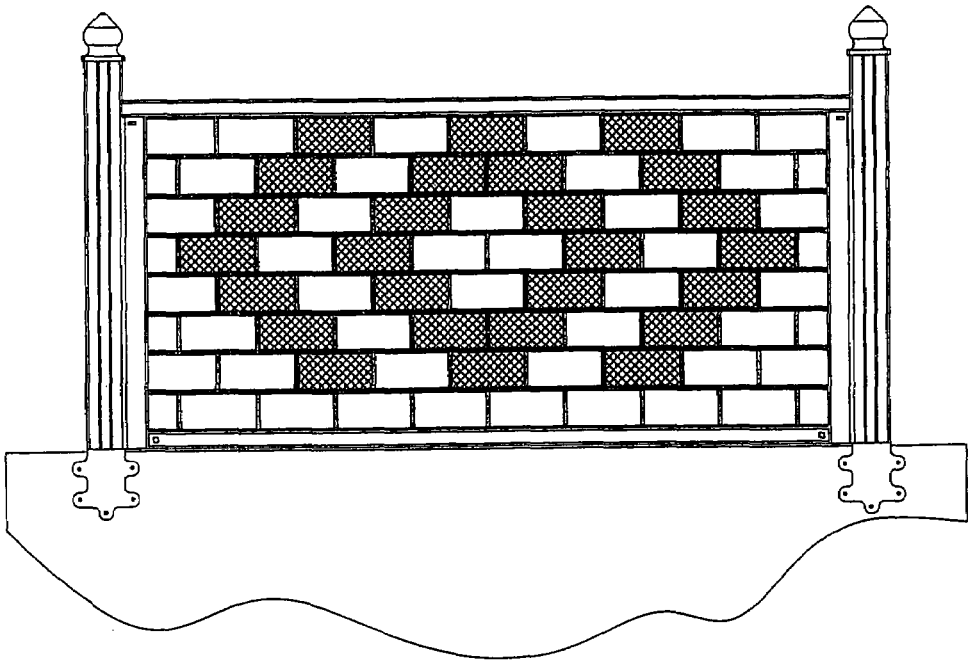
FIG. 18 is a front view to illustrate a further additional variation of the pattern of the wall with mortar, wherein the wall with mortar is securely installed to the top of an existing structure.
Figure 19:
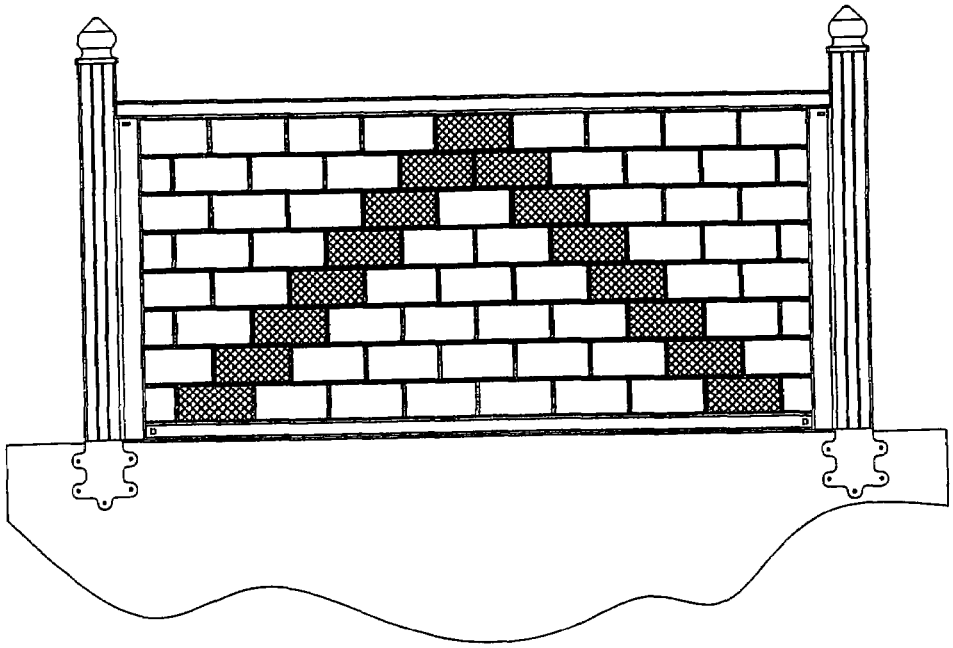
FIG. 19 is a front view to illustrate the last variation of the pattern of the wall with mortar, wherein the wall with mortar is securely installed to the top of an existing structure.
Figure 20:
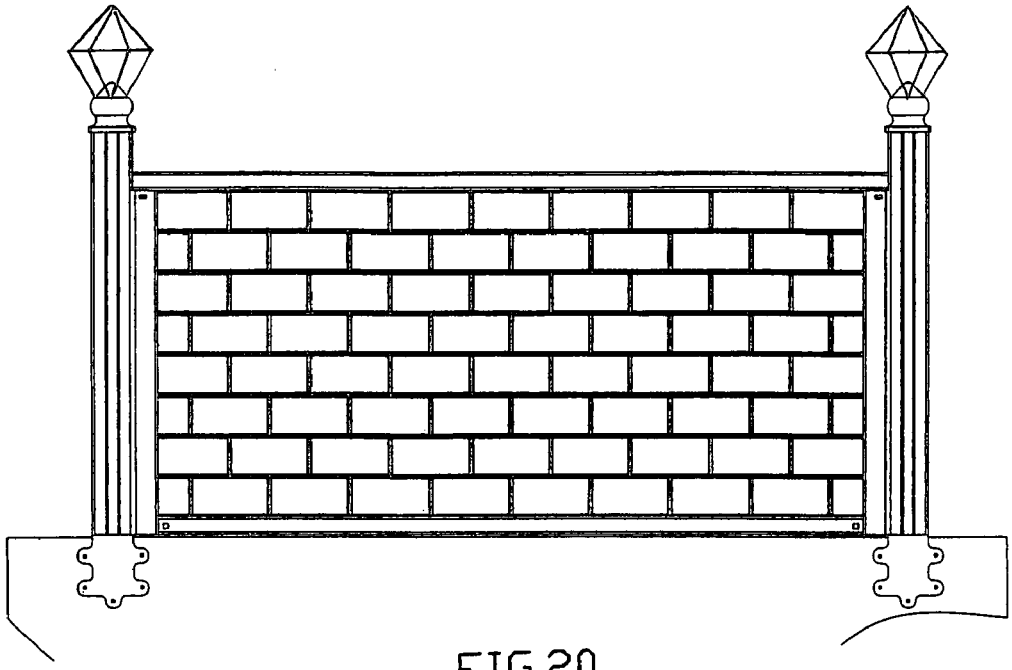
FIG. 20 is a front view to illustrate one variation of the post, wherein the top of the pose is decorated for ornamentation.

In a situation that the framed wall with mortar is to be installed into an existing structure for example, a short height existing wall, the present invention method for constructing walls includes another preferred step for the wall installation, which is illustrated in FIGS. 13A and 13B. The step of the wall installation first provides an identical right and left side wall supporter 982 and 992. The right side wall supporter 982 is comprised of a base 984 which is bent to be an open ended rectangle and a central vertical supporting mean 986 such as a rod or structure which is affixed at a center position of the base 984, wherein the opened ends of the base 984 extend downwardly and the vertical supporting means 986 extends upwardly. The right side wall supporter 982 is placed on a top 980*a* of an existing short height wall 980. A transverse fastener means 988 such as a screw affixes the open ends of the base 984 of the wall supporter 982 onto the wall 980. Similarly, the left side wall supporter 992 is affixed onto the wall. Then the right and left side vertical post 80 and 85 are affixed to the respective the right and left vertical frame member 40 and 50 through the interlocking connection which is described in FIG. 11. Therefore the framed wall having mortar with the right and left side vertical post can be installed into the wall 980 from inserting the bottom end 80*b* and 85*b* of the respective right side and left side vertical post 80 and 85 to cover the respective vertical supporting means 986 and 996 of the respective right side wall supporter 982 and left side wall supporter 992. For ornamentation, a right and left identical decorative structure 90 and 92 can be placed onto the respective top 80*a* and 85*a* of the respective right and left vertical post 80 and 85.

Figure 21:
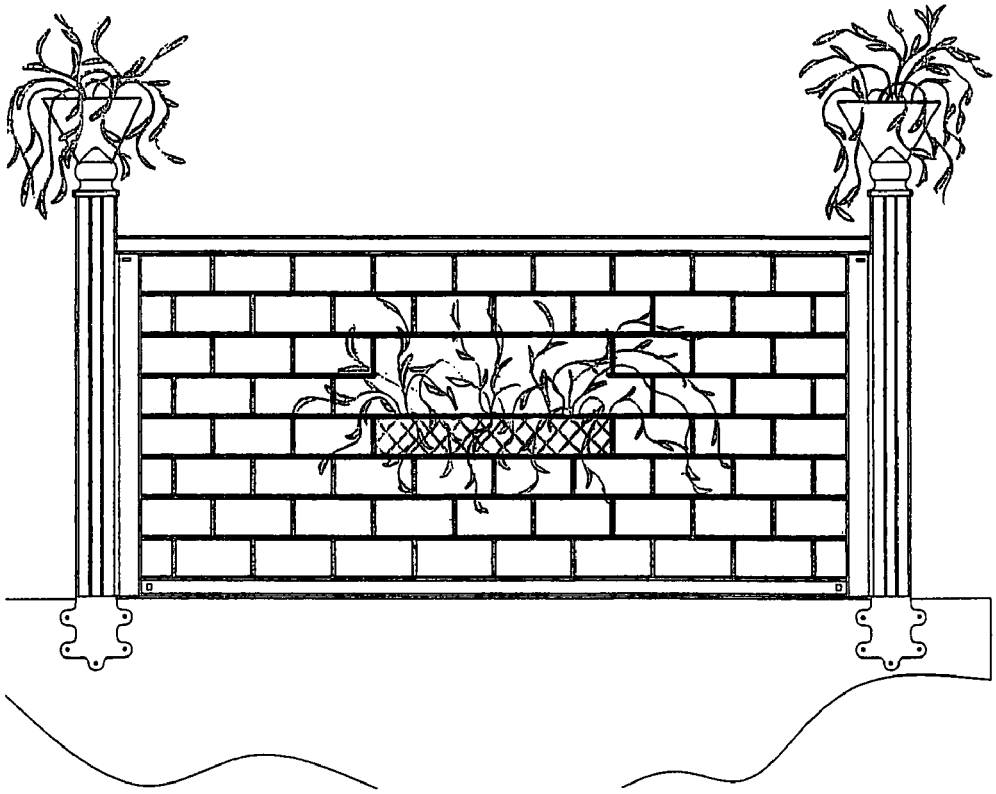
FIG. 21 is a front view to illustrate another variation of the post, wherein the top of the pose is decorated with flowers for ornamentation.

It will be further appreciated that the above illustration only introduces a method to construct a basic form of the wall with mortar and numerous variations are readily available following the spirit and scope of the present invention. For example, referring to FIG. 14, instead of having a plain vertical front and back side 100*a* and 100*b* of the standard block 100, a block 100' is readily available for having a decorated front and back side illustrated in FIG. 14 through coloring or adding different textures or both to the plain surface of the vertical sides of the blocks in manufacturing of the blocks 100'. With the aid of the blocks 100' with decorated vertical front and back sides the present invention method can create various designs of the wall with mortar, wherein the front and back surface of the wall present a specific pattern to significantly improve ornamentation of the wall. Such improvement is illustrated in FIGS. 14-19. Following the principle, even more complicated designs of the walls can be conducted, which is illustrated in FIG. 21. It will be appreciated that, the processes to assemble such decorated walls are readily understood to a person having ordinary skill in the art.

Figure 10:
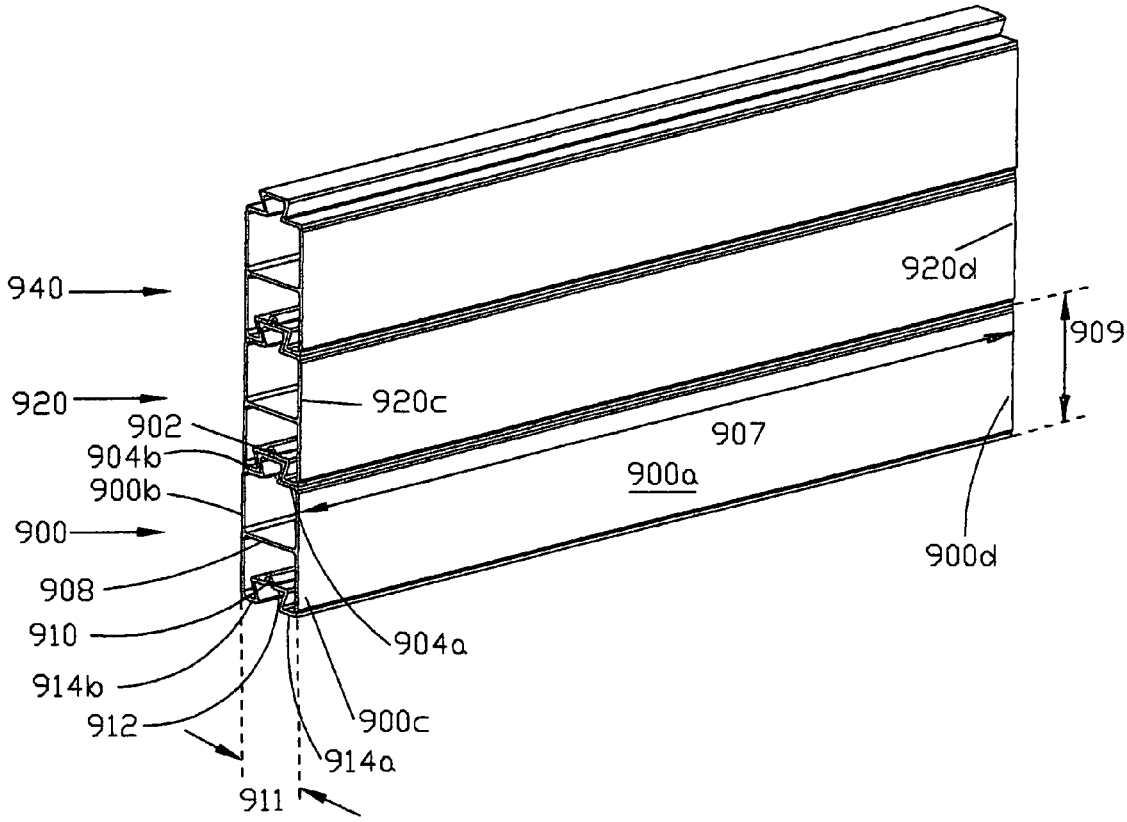
FIG. 10 is a perspective view of three identical straight longitudinal blocks which are used to illustrate the block interlocking affixation which is one of the fundamentals of the wall constructed with the present invention method, wherein three straight longitudinal blocks are stacked up through interlocking between an upper block and a lower block in the next section from a joinder of an elongated dovetail horizontal channel of the upper block and an elongated dovetail horizontal tongue of the lower block.

Referring to FIGS. 9 and 10, there is an illustrated additional preferred embodiment 3 wall with the straight longitudinal blocks from the present invention method for constructing walls. The additional preferred embodiment 3 of the wall is a framed straight longitudinal block assembly, for example, comprising the identical straight longitudinal blocks 900, 920, 940 and 960, the right and left vertical frame member 40 and 50, and the top and bottom horizontal frame member 20" and 10". As illustrated in FIG. 10, it will be appreciated that each identical straight longitudinal block 900 possesses the same structural features as those for the standard block 100 in FIG. 2A except for a elongated length 907 of the block 900, wherein the structure features of the straight longitudinal block 900 are illustrated in FIG. 10 in the same order and with the numbers having the same first and second digits except for the third digit of "9" as the numbers used in FIG. 2A for the block 100. Therefore, the disclosure of the detailed structure of the straight longitudinal block 900 will not be repeated. It will be further appreciated that the top and bottom horizontal frame member 20" and 10" have the same structure as that of the respective top and bottom horizontal frame member 20 and 10 illustrated in FIG. 3 except for the top horizontal frame member 20" has a length which is equal to a combined length of the straight longitudinal block length 907 plus twice the central thickness 41 of the right side vertical frame member 40, and the bottom horizontal frame member 10" having a length equal to a combined length of the straight block length 907 minus twice the depth 48*a* of the rectangular slot 48 of the vertical frame member 40.

In the assembly process, it will be appreciated that the bottom horizontal frame member is placed on the ground, wherein the frame bottom side 10"*b* contacts the ground. The first straight block 900 is then affixed to the top surface 10"*a* of the frame member 10" through the interlocking of the block dovetail slot 912 (not shown) to the frame member dovetail tongue 12" through a sliding movement of the block. It will be further appreciated that the right end 900*d* of the block is placed to over the right end 10"*f* of the frame member 10" a distance which is equal to the depth 48*b* of the rectangular slot 48 of the right vertical frame member 40. Similarly, the left end 900*c* of the block 900 is also over placed the same distance to the left end 10"*e* of the frame member 10". Adhesive will be injected into the half round slot 910 if a permanent joinder is desired between the frame member and the block. The second straight block 920 will be assembled to the top surface 904*a* and 904*b* following the same procedure that the first straight block 900 is assembled, wherein the right and left end 920*d* and 920*c* of the block 920 aligns the respective right and left end 900*d* and 900*c* of the first block 900. Following the same operation, the third and fourth straight block 940 and 960 are assembled to form a block assembly. The embodiment 3 of the wall with straight longitudinal blocks is completely assembled after the framing step of the present invention, and is ready for installation, wherein the framing step and the installation process are the same as those introduced for embodiment 1 of the plain wall.

It will be appreciated that the interlocking affixation is not limited to the dovetail structure for the blocks, vertical inserts, frame members and vertical posts which is introduced in above illustration of three preferred embodiments from the present invention method for constructing walls. As a matter of fact, various variations are readily available. For example, a round channel and slot are also effective from the spirit and scope of the present invention.

Defined in detail, the present invention is a structure for constructing a wall, comprising: providing a multiplicity of full sized blocks, half sized blocks, corner fasteners, frame members and vertical posts, each of the blocks being identical in structure and being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a block bottom side of each block, a half circle slot which extends over the length of and further evenly divides a back side of the elongated dovetail shaped channel, each block further having a respective top and bottom transverse elongated groove at a respective top and bottom edge of the respective front and back vertical side, the multiplicity of half sized blocks being the same shape as each full sized block but being shorter in length, the multiplicity of frame members including a top horizontal frame member and a bottom horizontal frame member, and a right vertical frame member and a left vertical frame member, the bottom horizontal frame member being an elongated rectangular hollow structure having a top horizontal side and a bottom horizontal side, a left end and a right end, a front vertical side and a back vertical side, and an inner vertical side which is located at a middle of the horizontal frame member wherein each vertical side has an opening adjacent to the respective right and left end of the horizontal frame member and each opening is adjacent to the same end and are aligned with each other, and a top dovetail shaped tongue being placed on a longitudinal center of the top horizontal side, the top horizontal frame member being an elongated rectangular hollow structure having a top horizontal side and a bottom horizontal side, a right end and a left end, a front vertical side and a back vertical side, wherein each horizontal side at a located adjacent to the respective right end and left end of the frame member has two openings wherein one opening is adjacent to the front vertical side and the other opening is adjacent to the back vertical side, a bottom dovetail channel located on a longitudinal center of the bottom horizontal side of the top horizontal frame member, the right and left side vertical frame member being a mirror image to each other, the right side vertical frame member having a left inner vertical side and a right outer vertical side, a top and bottom end, a front and back vertical side and an inner vertical side which is located at a central position of the frame member, wherein each vertical side has an opening adjacent to the top end of the frame member and each opening is aligned with each other, a dovetail shaped tongue being placed on the longitudinal center of the right outer vertical side, a left elongated rectangular channel being located at a longitudinal center of the left vertical side wherein a width of the channel matches the width of the blocks, the channel further having a back side, two openings being located on the respective right vertical outer side and inner back vertical side of the channel adjacent to the bottom end of the frame member wherein one opening is adjacent to the front vertical side and the other opening is adjacent to the back vertical side, the two openings adjacent to the respective front and back vertical side are respectively aligned together, the vertical posts being an identical right side vertical post and left side vertical post which are elongated cubic hollow structures having a top end and a bottom end, and four identical elongated vertical sides each of which includes a dovetail shaped slot placed on an elongated center of each vertical side, a fastener means having four sets of two fasteners, two spacers, and one horizontal member being a strip which contains two openings close to a respective front and back end of the strip.

Defined more broadly, the present invention is a structure for constructing a wall, comprising: providing a multiplicity of blocks, each of the blocks being identical in structure and being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a back bottom side of each block, a half circle slot which extends over the length of and further evenly divides a back side of the elongated dovetail shaped channel, each block further having a respective top and bottom transverse elongated groove at a respective top and bottom edge of the respective front and back vertical side, the multiplicity of frame members including a top horizontal frame member and a bottom horizontal frame member, and a right vertical frame member and a left vertical frame member, the bottom horizontal frame member being an elongated rectangular hollow structure having a top horizontal side and a bottom horizontal side, a left end and a right end, a front vertical side and a back vertical side, and a top dovetail shaped tongue being placed on a longitudinal center of the top horizontal side, the top horizontal frame member being an elongated rectangular hollow structure having a top horizontal side and a bottom horizontal side, a right end and a left end, a front vertical side and a back vertical side, a bottom dovetail channel located on a longitudinal center of the bottom horizontal side of the top horizontal frame member, the right and left side vertical frame member being a mirror image to each other, the right side vertical frame member having a left inner vertical side and a right outer vertical side, a top and bottom end, a front and back vertical side and an inner vertical side which is located at a central position of the frame member, a dovetail shaped tongue being placed on a longitudinal center of the outer vertical side of each vertical frame member, and fastening means by which the vertical frame members are affixed to the top and bottom horizontal frame members.

Defined most broadly, the present invention is a structure for constructing a wall, comprising: providing a multiplicity of blocks, each of the blocks being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a back bottom side of each block, the multiplicity of frame members including a top horizontal frame member and a bottom horizontal frame member, and a right vertical frame member and a left vertical frame member, the bottom horizontal frame member being an elongated rectangular hollow structure having a top horizontal side and a bottom horizontal side, a left end and a right end, a front vertical side and a back vertical side, and a top dovetail shaped tongue being placed on a longitudinal center of the top horizontal side, the top horizontal frame member being an elongated rectangular hollow structure having a top horizontal side and a bottom horizontal side, a right end and a left end, a front vertical side and a back vertical side, a bottom dovetail channel located on a longitudinal center of the bottom horizontal side of the top horizontal frame member, the right and left side vertical frame member being a mirror image to each other, the right side vertical frame member having a left inner vertical side and a right outer vertical side, a top and bottom end, a front and back vertical side, a dovetail shaped tongue being placed on a longitudinal center of the outer vertical side of each vertical frame member, and fastening means by which the vertical frame members are affixed to the top and bottom horizontal frame members.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A structure for constructing a wall, comprising: providing a multiplicity of full sized blocks, half sized blocks, corner fasteners, frame members and vertical posts, each of said blocks being identical in structure and being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a block bottom side of each block, a half circle slot which extends over the length of and further evenly divides a back side of said elongated dovetail shaped channel, each block further having a respective top and bottom transverse elongated groove at a respective top and bottom edge of the respective front and back vertical side, said multiplicity of half sized blocks being the same shape as each full sized block but being shorter in length, said multiplicity of frame members including a top horizontal frame member and a bottom horizontal frame member, and a right vertical frame member and a left vertical frame member, said bottom horizontal frame member being an elongated rectangular hollow structure having a top horizontal side and a bottom horizontal side, a left end and a right end, a front vertical side and a back vertical side, and an inner vertical side which is located at a middle of said bottom horizontal frame member wherein each vertical side has an opening adjacent to the respective right and left end of the horizontal frame member and each opening is adjacent to the same end and are aligned with each other, and a top dovetail shaped tongue being placed on a longitudinal center of the top horizontal side, said top horizontal frame member being an elongated rectangular hollow structure having a top horizontal side and a bottom horizontal side, a right end and a left end, a front vertical side and a back vertical side, wherein each horizontal side at a located adjacent to the respective right end and left end of the frame member has two openings wherein one opening is adjacent to the front vertical side and the other opening is adjacent to the back vertical side, a bottom dovetail channel located on a longitudinal center of the bottom horizontal side of the top horizontal frame member, said right and left side vertical frame member being a mirror image to each other, said right side vertical frame member having a left inner vertical side and a right outer vertical side, a top and bottom end, a front and back vertical side and an inner vertical side which is located at a central position of the frame member, wherein each vertical side has an opening adjacent to the top end of the frame member and each opening is aligned with each other, a dovetail shaped tongue being placed on the longitudinal center of the right outer vertical side, a left elongated rectangular channel being located at a longitudinal center of the left vertical side wherein a width of said channel matches said width of the blocks, said channel further having a back side, two openings being located on the respective right vertical outer side and inner back vertical side of the channel adjacent to the bottom end of the frame member wherein one opening is adjacent to the front vertical side and the other opening is adjacent to the back vertical side, said two openings adjacent to the respective front and back vertical side are respectively aligned together, said vertical posts being an identical right side vertical post and left side vertical post which are elongated cubic hollow structures having a top end and a bottom end, and four identical elongated vertical sides each of which includes a dovetail shaped slot placed on an elongated center of each vertical side, a fastener means having four sets of two fasteners, two spacers, and one horizontal member being a strip which contains two openings close to a respective front and back end of said strip.

2. A structure in accordance with claim 1 further comprising creating a wall section by resting the horizontal frame member on a horizontal surface and interlocking a first row of blocks by sliding a dovetail channel on a block onto the dovetail tongue of the horizontal frame member and erecting a wall with successive blocks interlocked with a dovetail channel of a block in each row interlocked with a dovetail tongue on one or more blocks of the immediately located lower row, the top horizontal frame member affixed to the uppermost row of blocks by sliding its dovetail channel onto the dovetail tongues of the uppermost row of blocks.

3. A structure in accordance with claim 2 wherein the left and right vertical frame members cover the outer ends of the body of the wall and are to affix each corner of the framed wall, so that the rectangular slot of the respective right and left vertical frame member covers the respective right and left outer end of the block assembly, wherein the bottom of the right and left vertical frame members are respectively aligned with the bottom side of the bottom horizontal frame member, and the top end of the right and left vertical frame members are respectively aligned with the top side of the blocks in the top section of the block assembly, the vertical frame members are respectively affixed to the upper and lower horizontal frame members by fastening means inserted into the opening located on the front, middle and back vertical side adjacent to the top of the left vertical side frame member, a front and back side spacer placed between the top of the horizontal member and bottom side of the top horizontal frame member wherein a center opening of the respective front and back side spacer aligns the respective openings on the horizontal top and bottom side adjacent to the respective front vertical and back side of the top frame member, a front and back side screw is used to affix the upper left corner by tightening the screw to a respective threaded hole of the horizontal member, for affixing the lower left corner, one horizontal member of the fastener system is inserted into the opening located on the front, middle and back vertical side adjacent to the left end of the bottom horizontal frame member, a front and back side spacer are placed between the horizontal member and the channel back side of the left side vertical frame member wherein a center opening of the respective front and back side spacer is aligned with the respective openings on the left vertical side and the channel back vertical side adjacent to the respective front and back vertical sides and the bottom of the left vertical frame member, a front and back side screw is used to affix the lower left corner by tightening the screw to the respective threaded hole of the horizontal member, so that the dovetail tongue of each vertical frame member extends outwardly from the assembly.

4. A structure in accordance with claim 1 further comprising vertical and horizontal inserts, each vertical insert being a flat structure having the same structural features as those of the blocks except for a recess width, said each vertical insert being alternatively placed between two blocks in series, each of said horizontal inserts being an elongated strip which is placed into a combined groove which is formed by each bottom groove of a vertical side of each block and vertical insert in an upper section of the block and insert assembly and each top groove of the same vertical side of each block and vertical insert in the next lower section.

5. A structure in accordance with claim 4 wherein each insert simulates mortar.

6. A structure in accordance with claim 1 further comprising affixing the bottom end of said right and left side vertical post into the ground, wherein one of the cubic vertical sides of the left side vertical post is parallel to one of the cubic vertical sides of the right side vertical post, and inserting an outwardly facing dovetail tongue of a vertical frame member into a vertical channel in a post.

7. A structure in accordance with claim 1 said blocks, frame member and posts are made of material selected from the group consisting of plastic, polyurethane, aluminum, aluminum alloy, steel and wood.

8. A structure in accordance with claim 1 further comprising binding material injected into each said half cycle slot for a permanent joinder of said block assembly.

9. A structure in accordance with claim 1 further comprising each vertical side of some full sized blocks are colored or in different textures or both.

10. A structure for constructing a wall, comprising: providing a multiplicity of blocks, each of said blocks being identical in structure and being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a back bottom side of each block, a half circle slot which extends over the length of and further evenly divides a back side of said elongated dovetail shaped channel, each block further having a respective top and bottom transverse elongated groove at a respective top and bottom edge of the respective front and back vertical side, a multiplicity of frame members including a top horizontal frame member and a bottom horizontal frame member, and a right vertical frame member and a left vertical frame member, said bottom horizontal frame member being an elongated rectangular hollow structure having a top horizontal side and a bottom horizontal side, a left end and a right end, a front vertical side and a back vertical side, and a top dovetail shaped tongue being placed on a longitudinal center of the top horizontal side, said top horizontal frame member being an elongated rectangular hollow structure having a top horizontal side and a bottom horizontal side, a right end and a left end, a front vertical side and a back vertical side, a bottom dovetail channel located on a longitudinal center of the bottom horizontal side of the top horizontal frame member, said right and left side vertical frame member being a mirror image to each other, said right side vertical frame member having a left inner vertical side and a right outer vertical side, a top and bottom end, a front and back vertical side and an inner vertical side which is located at a central position of the frame member, a dovetail shaped tongue being placed on a longitudinal center of the outer vertical side of each vertical frame member, and fastening means by which the vertical frame members are affixed to the top and bottom horizontal frame members.

11. A structure in accordance with claim 10 further comprising creating a wall section by resting the horizontal frame member on a horizontal surface and interlocking a first row of blocks by sliding a dovetail channel on a block onto the dovetail tongue of the horizontal frame member and erecting a wall with successive blocks interlocked with a dovetail channel of a block in each row interlocked with a dovetail tongue on one or more blocks of the immediately located lower row, the top horizontal frame member affixed to the uppermost row of blocks by sliding its dovetail channel onto the dovetail tongues of the uppermost row of blocks.

12. A structure in accordance with claim 11 wherein the left and right vertical frame members cover the outer ends of the body of the wall and are respectively affixed to an end of the top horizontal frame member and the bottom horizontal frame member so that the dovetail tongue of each vertical frame member extends outwardly from the assembly.

13. A structure in accordance with claim 10 further comprising vertical and horizontal inserts, each vertical insert being a flat structure, said each vertical insert being alternatively placed between two blocks in series, each of said horizontal inserts being an elongated strip which is placed into a combined groove which is formed by each bottom groove of a vertical side of each block and vertical insert in an upper section of the block and insert assembly and each top groove of the same vertical side of each block and vertical insert in the next lower section.

14. A structure in accordance with claim 13 wherein each insert simulates mortar.

15. A structure in accordance with claim 10 further comprising binding material injected into each said half cycle slot for a permanent joinder of said block assembly.

16. A structure for constructing a wall, comprising: providing a multiplicity of blocks, each of said blocks being in the shape of an elongated hollow rectangle having a front vertical side and an opposite parallel back vertical side, a right end and left end, a top elongated dovetail shaped tongue located at a longitudinal center of a top rectangular side of each block, a bottom elongated dovetail shaped channel having a back side located at a longitudinal center of a back bottom side of each block, a multiplicity of frame members including a top horizontal frame member and a bottom horizontal frame member, and a right vertical frame member and a left vertical frame member, said bottom horizontal frame member being an elongated rectangular hollow structure having a top horizontal side and a bottom horizontal side, a left end and a right end, a front vertical side and a back vertical side, and a top dovetail shaped tongue being placed on a longitudinal center of the top horizontal side, said top horizontal frame member being an elongated rectangular hollow structure having a top horizontal side and a bottom horizontal side, a right end and a left end, a front vertical side and a back vertical side, a bottom dovetail channel located on a longitudinal center of the bottom horizontal side of the top horizontal frame member, said right and left side vertical frame member being a mirror image to each other, said right side vertical frame member having a left inner vertical side and a right outer vertical side, a top and bottom end, a front and back vertical side, a dovetail shaped tongue being placed on a longitudinal center of the outer vertical side of each vertical frame member, and fastening means by which the vertical frame members are affixed to the top and bottom horizontal frame members.

17. A structure in accordance with claim 16 further comprising creating a wall section by resting the horizontal frame member on a horizontal surface and interlocking a first row of blocks by sliding a dovetail channel on a block onto the dovetail tongue of the horizontal frame member and erecting a wall with successive blocks interlocked with a dovetail channel of a block in each row interlocked with a dovetail tongue on one or more blocks of the immediately located lower row, the top horizontal frame member affixed to the uppermost row of blocks by sliding its dovetail channel onto the dovetail tongues of the uppermost row of blocks.

18. A structure in accordance with claim 17 wherein the left and right vertical frame members cover the outer ends of the body of the wall and are respectively affixed to an end of the top horizontal frame member and the bottom horizontal frame member so that the dovetail tongue of each vertical frame member extends outwardly from the assembly.

19. A structure in accordance with claim 16 said blocks, frame member and posts are made of material selected from the group consisting of plastic, polyurethane, aluminum, aluminum alloy, steel and wood.

20. A structure in accordance with claim 16 further comprising each vertical side of some full sized blocks are colored or in different textures or both.

* * * * *